US008191589B2

(12) United States Patent
Suzuki et al.

(10) Patent No.: US 8,191,589 B2
(45) Date of Patent: Jun. 5, 2012

(54) METHOD OF PROCESSING WOOD AND COMPRESSED WOOD PRODUCT

(75) Inventors: Tatsuya Suzuki, Tokyo (JP); Masanobu Okumura, Hachioji (JP)

(73) Assignee: Olympus Corporation, Tokyo (JP)

( * ) Notice: Subject to any disclaimer, the term of this patent is extended or adjusted under 35 U.S.C. 154(b) by 891 days.

(21) Appl. No.: 11/571,653

(22) PCT Filed: Sep. 14, 2006

(86) PCT No.: PCT/JP2006/318660

§ 371 (c)(1),
(2), (4) Date: Oct. 27, 2008

(87) PCT Pub. No.: WO2007/037160

PCT Pub. Date: Apr. 5, 2007

(65) Prior Publication Data

US 2009/0208766 A1 Aug. 20, 2009

(30) Foreign Application Priority Data

Sep. 29, 2005 (JP) ..... 2005-284628
Oct. 28, 2005 (JP) ..... 2005-315066
Dec. 20, 2005 (JP) ..... 2005-366744

(51) Int. Cl.
*B27M 1/00* (2006.01)

(52) U.S. Cl. ..... 144/364; 144/380

(58) Field of Classification Search ..... 144/364, 144/380; 427/254, 325
See application file for complete search history.

(56) References Cited

U.S. PATENT DOCUMENTS 2,093,652 A * 9/1937 Widmer et al. ..... 264/75
2,789,890 A * 4/1957 Stevens ..... 44/534
5,343,913 A * 9/1994 Tanahashi et al. ..... 144/380
2003/0129319 A1 7/2003 Johansson

FOREIGN PATENT DOCUMENTS

DE 102 24 721 A1 1/2003
GB 397 513 8/1933
JP 61118201 A 6/1986
JP 06000803 A 1/1994
JP 06170809 A 6/1994
JP 06329656 A 11/1994

(Continued)

OTHER PUBLICATIONS

Japanese language office action and its partial English language translation for corresponding Japanese application 2005284628 lists the references above.

(Continued)

*Primary Examiner* — Shelley Self
(74) *Attorney, Agent, or Firm* — Hogan Lovells US LLP

(57) ABSTRACT

A desired property is readily granted to a wooden piece (1) subjected to compression. When the wooden piece (1) is processed by a pair of metal molds (51, 61), a property granting liquid (101) is applied to a surface of at least one (61) of the metal molds (51, 61) which comes into contact with a surface of the wooden piece (1). The property granting liquid (101) is in liquid state at temperatures of 5 to 35 C and grants a certain property to the surface of the wooden piece (1). The wooden piece (1) is sandwiched and compressed by the pair of metal molds (51, 61) including the metal mold (61) to which the property granting liquid (101) is applied.

14 Claims, 19 Drawing Sheets

FOREIGN PATENT DOCUMENTS

| | | | |
|---|---|---|---|
| JP | 08-025301 | | 1/1996 |
| JP | 08267411 | A | 10/1996 |
| JP | 11-077619 | | 3/1999 |
| JP | 11-151703 | A | 6/1999 |
| JP | 2000229041 | A | 8/2000 |
| JP | 2001145906 | A | 5/2001 |
| JP | 2001252907 | A | 9/2001 |
| JP | 2002283311 | A | 10/2002 |
| JP | 2003526539 | A | 9/2003 |
| JP | 2005-027199 | A | 1/2005 |
| JP | 2005-153364 | | 6/2005 |
| JP | 2005172950 | A | 6/2005 |
| JP | 2005186539 | A | 7/2005 |
| JP | 2005305649 | A | 11/2005 |
| JP | 2005310806 | A | 11/2005 |
| SU | 469599 | | 5/1975 |
| WO | WO 2005/055564 | A1 | 6/2005 |

OTHER PUBLICATIONS

Japanese language office action and its partial English language translation for corresponding Japanese application 2005315066 lists the references above.

* cited by examiner

METHOD OF PROCESSING WOOD AND COMPRESSED WOOD PRODUCT

CROSS-REFERENCE TO THE RELATED APPLICATIONS

This application is a national phase of the international application No. PCT/JP2006/318660 filed Sep. 14, 2006, the entire contents of which are incorporated by reference. This application also claims benefit of priority under 35 U.S.C. §119 to Japanese Application No. 2005-284628 filed Sep. 29, 2005, Japanese Application No. 2005-315066 filed Oct. 28, 2005 and Japanese Application No. 2005-366744 filed Dec. 20, 2005, the entire contents of all of which are incorporated by reference.

TECHNICAL FIELD

The present invention relates to a method of processing wood according to which wood is processed into a three-dimensional shape, and a compressed wood product formed from wood through compression.

This application is based upon and claims the benefit of priority from Japanese Patent Applications No. 2005-284628, filed Sep. 29, 2005; No. 2005-315066, filed Oct. 28, 2005; and No. 2005-366744, filed Dec. 20, 2005, the entire contents of which are incorporated herein by reference.

BACKGROUND ART

In recent years, wooden materials that are natural, materials attract attention. With a wide variety of grain patterns, wood products made of wood exhibit individual features depending on positions of the raw wood from which the particular wood products are cut out. Such individual features, of each wood product give it a unique quality. In addition, surface flaws and discolorations caused by a long-term use create unique textures which tend to evoke warm and familiar feeling in the user. Thus, the wooden material attracts attention as a material for products of uniqueness and taste which cannot be found in products made of synthetic resin or light metals. Techniques for processing wooden materials are also developing dramatically.

According to one conventionally known technique for processing wooden materials: a wooden board is softened with water absorption and compressed; the compressed wooden board is cut along a direction substantially parallel with a direction in which the compressive force is applied, whereby a primary fixed product with a sheet-like shape is obtained; and the primary fixed product is deformed into a desired three-dimensional shape under heat and moisture (for example, see Japanese Patent No. 3078452 Publication). Further, according to another conventional technique, a softened wooden sheet is compressed and temporarily secured in a prepared mold and left in the mold until the wooden sheet recovers. Thus a wooden product with a desired shape can be obtained (see, for example, Japanese Patent Application Laid-Open No. H11-77619 Publication). The wood products formed through these processing techniques have sufficient strength for application to jackets of electronic equipments (see Japanese Patent Application Laid-Open No. 2005-153364 Publication).

DISCLOSURE OF INVENTION

The compressed wood product manufactured as described above is sometimes subjected to a further treatment for grant of property which is not inherent in wood or property lost through the compression process. Such treatment is performed, for example, for improvement of strength or durability of the wood product, for supplement of essential oil of the wood product lost through the compression, or for grant of flame-retardancy to the wood product. In general, at the treatment, suitable agent or the like selected according to the desired property is injected or impregnated into the wood product through the surface thereof.

The process of injection or impregnation of the agent or the like is, however, performed as a separate process and therefore is time consuming. In addition, when such process is performed to raw wood before compression, the agent does not sometimes permeate evenly through the surface and a desired property cannot always be granted.

In view of the foregoing, an object of the present invention is to provide a method of processing wood which can grant the wood to be compressed a desired property in a simplified manner, and to provide a compressed wood product manufactured by such a method.

In order to solve the problems as described above and to achieve the object, according to one aspect of the present invention, a method of processing a wooden piece by a pair of metal molds includes applying a property granting liquid to a surface of at least one of the metal molds of the pair, wherein the surface comes into contact with a surface of the wooden piece, and the property granting liquid is in liquid state at temperatures of 5 to 35° C. and can grant a certain property to the surface of the wooden piece; and the method further includes compressing the wooden piece with the wooden piece sandwiched by the pair of metal molds including the metal mold to which the property, granting liquid is applied.

The property granting liquid may be oil whose boiling point is equal to or higher than 230° C.

The wooden piece may be compressed into a dish-like shape, and the oil may be applied to the surface of the metal mold which comes into contact with a surface of the wooden piece corresponding to an outer surface of the wooden piece as compressed into the dish-like shape.

The compressing may be performed in a water vapor atmosphere of a higher temperature and pressure than temperature and pressure of atmospheric air, and the property granting liquid may be an essential oil containing liquid containing essential oil which is in liquid state or solid state in the atmosphere in which the compressing is performed.

The essential oil may be contained in a sap component of wood of a same type as the wooden piece.

The essential oil may be contained in a sap component of wood of a different type from the wooden piece.

The essential oil containing liquid may be prepared by dissolving the essential oil in a solvent which is in liquid state at temperatures of 5 to 35° C.

The essential oil containing liquid may be prepared by dispersing the essential oil in a disperse medium which is in liquid state at temperatures of 5 to 35° C.

The essential oil containing liquid may contain plural types of essential oil.

The wooden piece may be compressed into a dish-like shape, and the essential oil containing liquid may be applied to the surface of the metal mold which comes into contact with a surface of the dish-like wooden piece, wherein the surface of the dish-like wooden piece corresponds to an outer surface of the wooden piece as compressed into the dish-like shape.

The compressing may be performed in a water vapor atmosphere of a higher temperature and pressure than temperature and pressure of atmospheric air, and the property granting liquid may be a flame-retardant liquid which is in liquid state or solid state in the atmosphere in which the compressing is performed.

The compressing may include heating at least one of the pair of metal molds of the pair up to a temperature higher than a carbonizing temperature of the wooden piece, compressing the wooden piece by the heated metal mold, and carbonizing a surface of the wooden piece which abuts the heated metal mold.

The metal mold heated in the compressing may be the metal mold to which the flame-retardant liquid is applied.

The method may further include carbonizing at least one side surface of the wooden piece, wherein the carbonizing is performed as a separate step from the compressing.

According to another aspect of the present invention, a compressed wood product formed from a wooden piece by compression includes a property granting liquid which is impregnated into at least a portion of a surface layer of the wooden piece. The property granting liquid is in liquid state at temperatures of 5 to 35° C., and grants a certain property to the wooden piece.

The property granting liquid may be applied to a surface of at least one of the metal molds, wherein the surface comes into contact with a surface of the wooden piece, and the property granting liquid is impregnated into the wooden piece by compressing the wooden piece with the wooden piece sandwiched by the pair of metal molds including the metal mold to which the property granting liquid is applied.

The property granting liquid may be oil whose boiling point is equal to or higher than 230° C.

The property granting liquid may be an essential oil containing liquid containing essential oil which is in liquid state or solid state in an atmosphere in which the wooden piece is compressed.

The compressed wood product may have a dish-like shape, and the property granting liquid is applied to the surface of the metal mold which comes into contact with a surface of the wooden piece corresponding to an outer surface of the compressed wood product in dish-like shape.

The property granting liquid may be a flame-retardant liquid which is in liquid state or solid state in an atmosphere in which the wooden piece is compressed.

Still further according to another aspect of the present invention, the compressed wood product may be a cover member which covers an electronic equipment.

According to the present invention, when the wooden piece is processed by a pair of metal molds, the property granting liquid, which is in liquid state at temperatures of 5 to 35° C. and grants a certain property to the surface of the wooden piece, is applied to a surface of at least one of the metal molds which comes into contact with a surface of the wooden piece, and then the wooden piece is sandwiched and compressed by the pair of metal molds including the metal mold to which the property granting liquid is applied, whereby a desired property is readily granted to the wooden piece subjected to compression.

BEST MODE(S) FOR CARRYING OUT THE INVENTION

Preferred embodiments of the present invention (hereinafter simply referred to as embodiments) will be described below with reference to the accompanying drawings.

Figure 1:
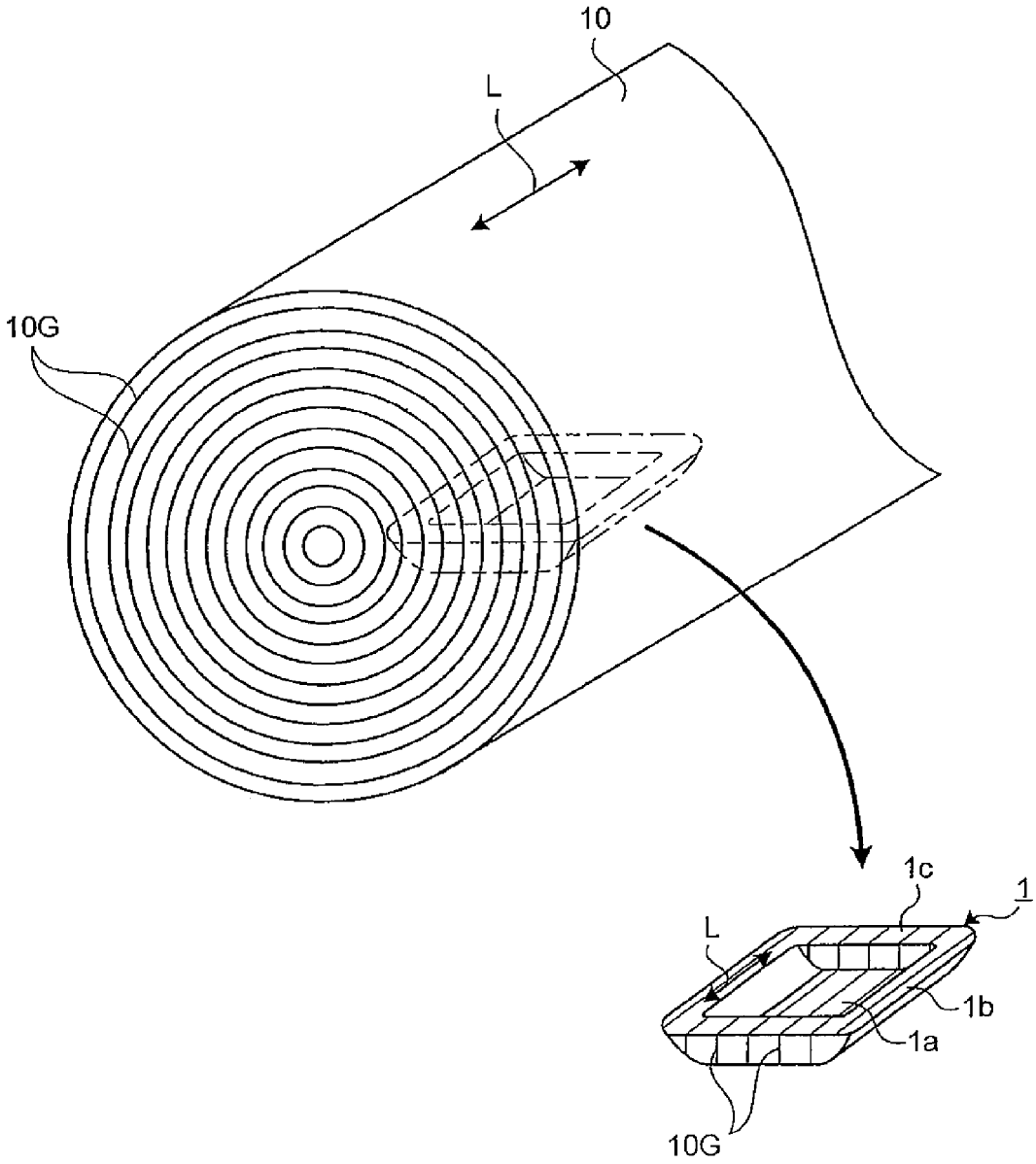
FIG. 1 schematically shows a cutting-out process of a method of processing wood according to a first embodiment of the present invention.

A first embodiment of the present invention intends to improve strength and durability of a wooden piece by impregnating oil, which is a property-granting liquid, into a surface of the wooden piece to be subjected to compression. In a method of processing wood according to the first embodiment, firstly, a wooden piece of a predetermined shape is cut out from raw wood (cutting-out process). FIG. 1 schematically shows an outline of the cutting-out process. A wooden piece 1 shown in FIG. 1 is cut out from uncompressed raw wood 10 (having a grain pattern 10G) by cutting or the like. The wooden piece 1 includes a substantially rectangular main plate portion 1*a*, two side plate portions 1*b* that extend in a lengthwise direction of the main plate portion 1*a* making a predetermined angle to the main plate portion 1*a* and two side plate portions 1*c* that extend a breadthwise direction of the main plate portion 1*a* making a predetermined angle to the main plate portion 1*a*, and has a substantially dish-like shape (here, "dish-like" shape includes bowl-like shape, shell-like shape, box-like shape, and the like). The wooden piece 1 has a volume which is larger than a finished product by an amount to be decreased during compression process described later.

FIG. 1 shows the wooden piece 1 cut out from the raw wood 10 as having wooden fibers running in a direction L which is substantially parallel with the lengthwise direction of the wooden piece 1, so that the surface of the main plate portion 1*a* shows a straight-grain pattern. Such manner of cutting-out is described merely, as an example. Alternatively, the wooden piece 1 may be cut out so that the direction L of wooden fibers of the wooden piece 1 is substantially parallel with the lengthwise direction thereof, though the surface of the main plate portion 1*a* shows a flat-grain pattern, or an intermediate grain pattern of the flat-grain and the straight-grain. Still alternatively, the wooden piece 1 may be cut out so that the direction L of wooden fibers of the wooden piece 1 is substantially perpendicular to the lengthwise direction thereof and the surface of the main plate portion 1*a* shows an end-grain pattern. Thus, the manner of cutting-out of the wooden piece from the raw wood is determined depending on the required condition of the wooden piece, such as strength and appearance. Hence, in the drawings to be referred to hereinbelow, the grain pattern is not particularly shown.

The raw wood 10 may be selected, for example, from various types of wood, such as, Japanese cypress, hiba cedar, paulownia, Japanese cedar, pine, cherry, zelkova, ebony wood, bamboo, teak, mahogany, and rosewood as appropriate depending on the use of the processed wooden piece. The wooden piece may be cut out from the raw wood in a flat board-like shape.

Figure 2:
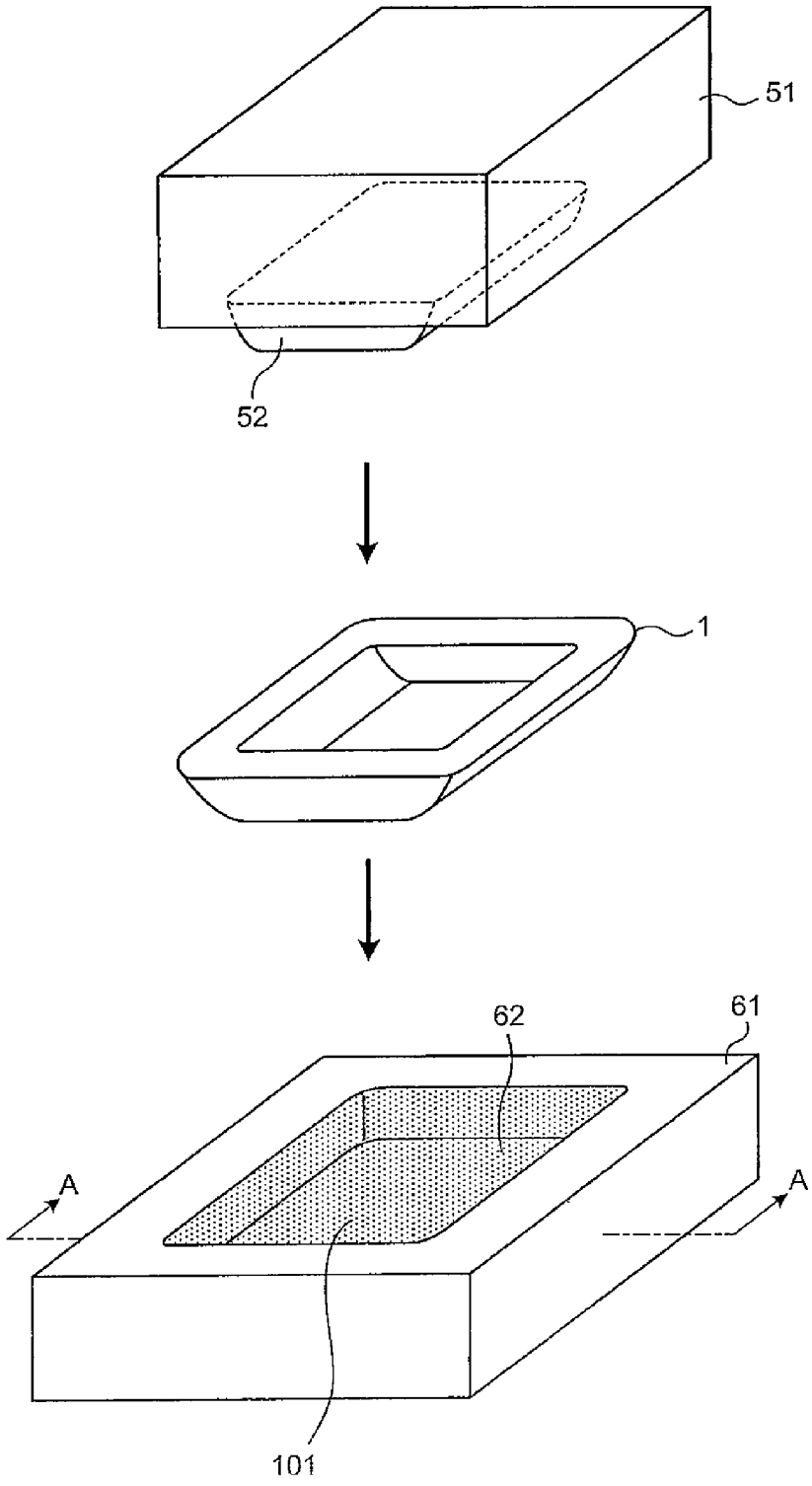
FIG. 2 shows a configuration of metal molds to be used in the method of processing wood according to the first embodiment of the present invention and a wooden piece before compression.
Figure 3:
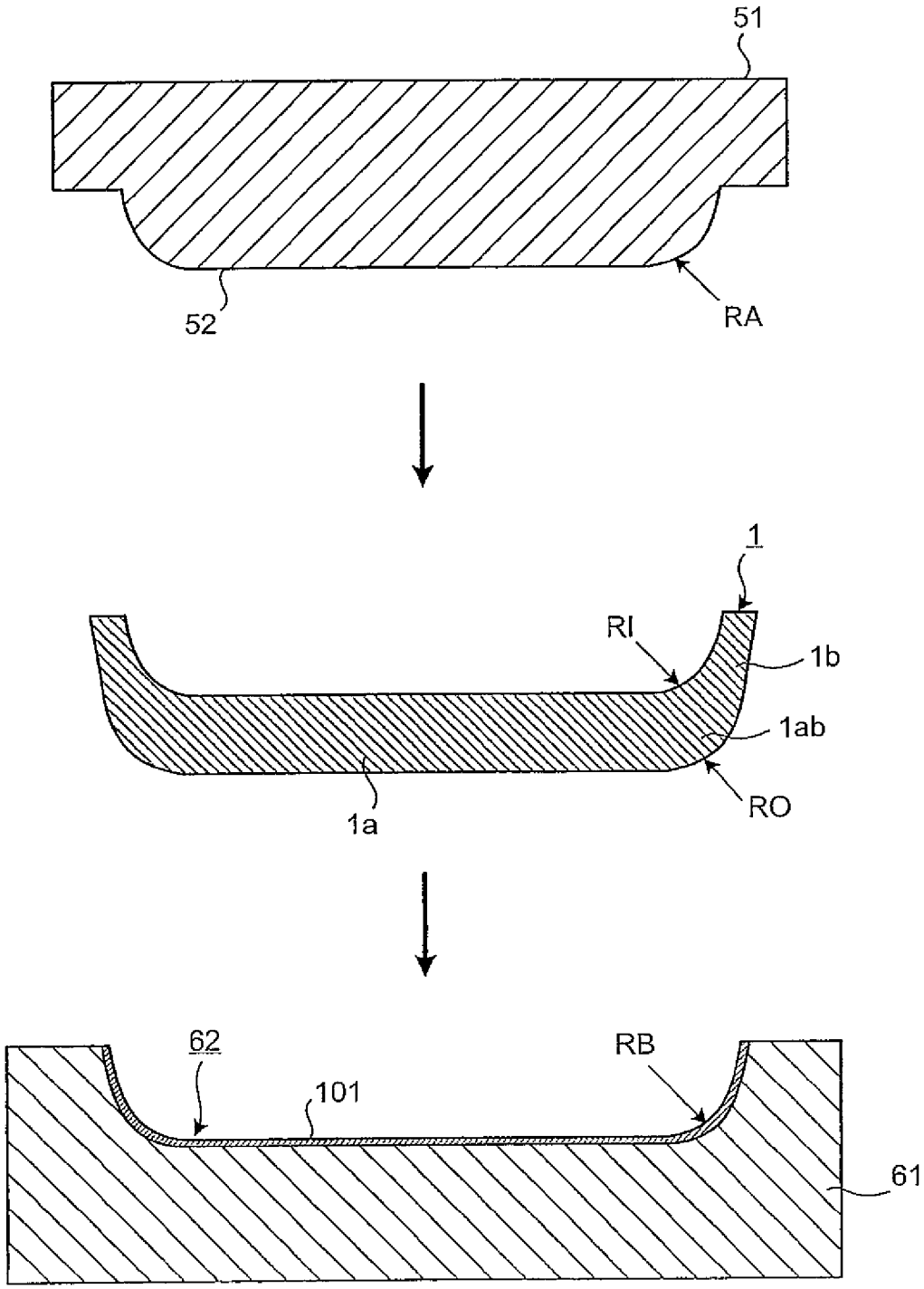
FIG. 3 is a sectional view taken along line A-A of FIG. 2.

FIG. 2 shows a configuration of metal molds used in the method of processing wood according to the first embodiment and the wooden piece 1 before compression, and FIG. 3 is a sectional view taken along line A-A of FIG. 2. As shown in FIGS. 2 and 3, the wooden piece 1 is sandwiched and compressed by a pair of metal molds 51 and 61. Of the pair of metal molds, a metal mold 51 which applies compressive force to the wooden piece 1 from above during compression is a core metal mold which has a protrusion 52 that fits to the internal, face extending and curving from the main plate portion 1*a* to the side plate portions 1*b* and 1*c* of the wooden piece 1. When the radius of curvature of an internal face of a curved portion 1*ab* extending from the main plate portion 1*a* to the side plate, portion 1*b* of the wooden piece 1 is represented as RI, and the radius of curvature of a curved surface of the protrusion 52, which abuts the curved portion 1*ab*, is represented as RA, relation represented by RI>RA holds.

On the other hand, a metal mold 61 which applies compressive force to the wooden piece 1 from below during compression is a cavity metal mold which has a depression 62 that fits to an external face extending and curving from the main plate portion 1*a* to the side plate portions 1*b* and 1*c* of the wooden piece 1. When the radius of curvature of an external face of the curved portion 1*ab* extending from the main plate portion 1*a* to the side plate portion 1*b* of the wooden piece 1 is represented as RO, and the radius of curvature of a curved surface of the depression 62, which abuts the external face, of the curved portion 1*ab* is represented as RB, relation represented by RO>RB holds.

Oil 101, which is a property granting liquid that grants a predetermined property to the surface of the wooden piece 1, is applied on a surface of the depression 62 of the metal mold 61 (i.e., metal mold surface that comes into contact with an outer, surface of the dish-like wooden piece 1). The oil 101 is applied to the surface of the depression 62 while at a room temperature (approximately 5 to 35° C.) or higher before the wooden piece 1 is placed/between the metal molds 51 and 61. The oil 101 employed in the oil application process has to be in liquid state at least at the room temperature. Then, the oil 101 can be applied to the surface of the depression 62 by a brush, a roller, or a spray, whereby the oil application process can be performed easily and speedily.

After the application of oil 101 to the surface of the depression 62 of the metal mold 61 in the oil application process, the wooden piece 1 is compressed by the metal molds 51 and 61 (compression process). In preparation for the compression process, the wooden piece 1 is left in a water vapor atmosphere of a temperature and pressure higher than those of an atmospheric air for a predetermined time period, whereby the wooden piece 1 is softened through absorption of moisture in excess. Here, the high temperature is 100 to 230° C. and preferably approximately 180 to 230° C. and more preferably approximately 180 to 200° C., and the high pressure is 0.1 to 3.0 MPa (MegaPascal), preferably approximately 0.45 to 2.5 MPa, and more preferably approximately 1.0 to 1.6 MPa. Alternatively, the wooden piece 1 may be heated and softened by application of high-frequency electromagnetic waves such as microwaves rather than by being left in the water vapor atmosphere as described above.

Figure 4:
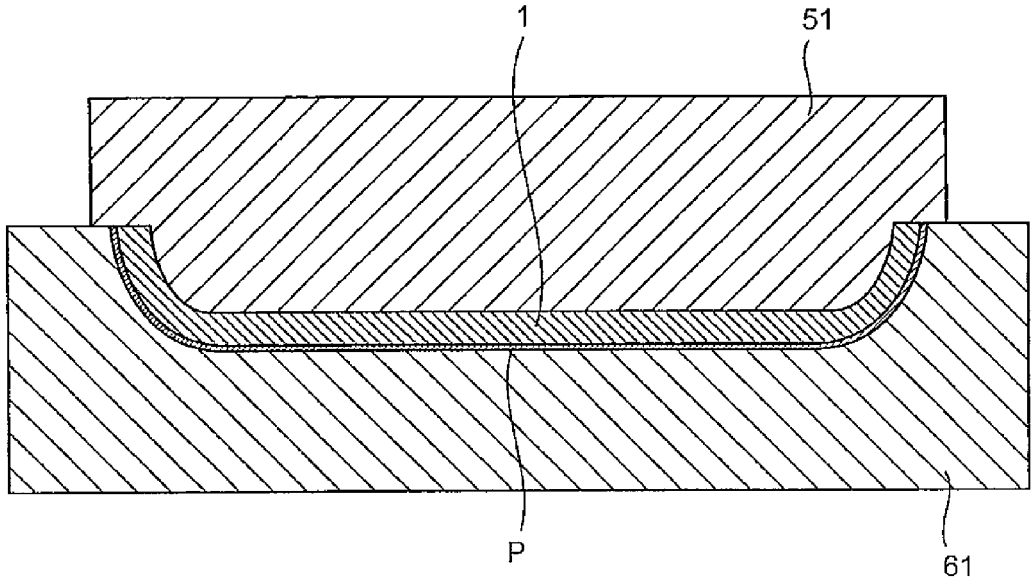
FIG. 4 is a sectional view of the wooden piece and the metal molds during a compression process of the method of processing wood according to the first embodiment of the present invention.

Thereafter, the wooden piece 1 is compressed in the water vapor atmosphere as described above. FIG. 4 shows the softened wooden piece 1 placed at a predetermined position, sandwiched between the lowered metal mold 51 and the metal mold 61, and subjecting to a predetermined compressive force. In FIG. 4, the deformation of the wooden piece 1 by compression has nearly completed. As shown in FIG. 4, the wooden piece 1 is deformed into a three-dimensional shape corresponding to a shape of a gap between the metal molds 51 and 61 by the application of compressive force from the metal molds 51 and 61. During compression, the oil 101 applied on the surface of the depression 62 gradually soaks into the external face of the wooden piece 1 due to the compressive force, and forms an oil impregnated portion P.

Figure 5:
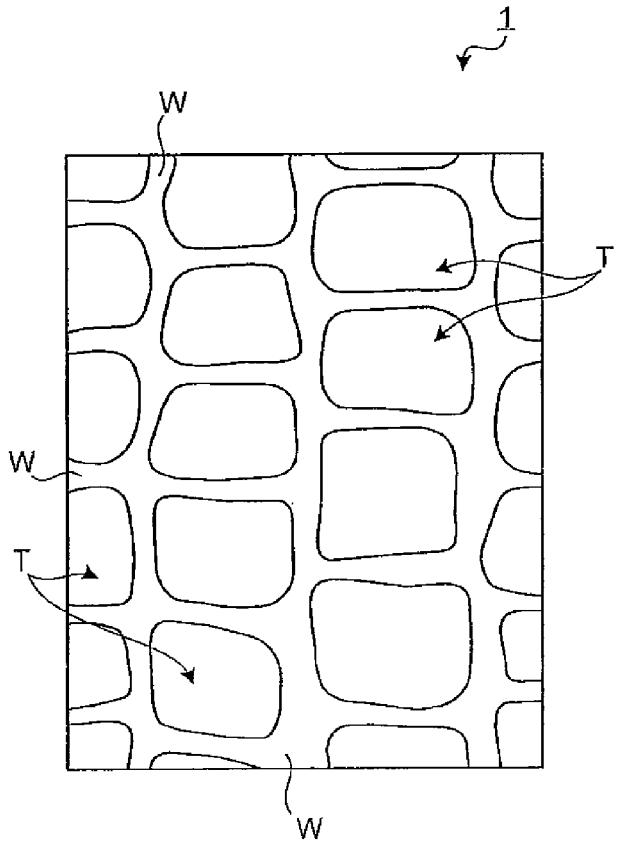
FIG. 5 schematically shows a configuration of a section of the wooden piece in a direction perpendicular to a direction of wooden fibers in the wooden piece before compressed into a compressed wood product of the first embodiment of the present invention.
Figure 6:
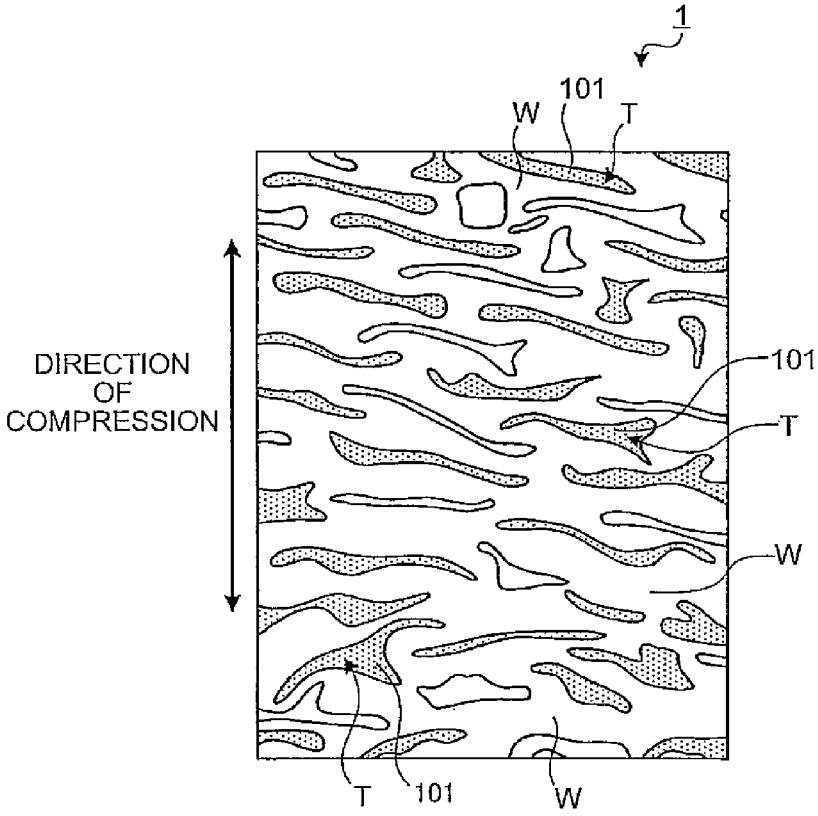
FIG. 6 schematically shows a configuration of a section of the wooden piece in a direction perpendicular to the direction of wooden fibers in the wooden piece after compressed into the compressed wood product of the first embodiment of the present invention.

FIGS. 5 and 6 schematically show a portion of a surface layer of the wooden piece 1 before and after a soak of the oil 101. More specifically, FIGS. 5 and 6 schematically show a section perpendicular to the direction L of wooden fibers in the surface layer of the wooden piece 1 before (FIG. 5) and after (FIG. 6) the compression, wherein the wooden piece 1 is taken from softwood (such as Japanese cypress, or hiba cedar). As shown in FIGS. 5 and 6, the wooden piece 1 has series of tracheids T surrounded by cell wall W. The tracheid T has a relatively large opening before the compression as shown in FIG. 5, whereas the opening becomes small as the cell wall W is pressed in a direction of compression after the compression as shown in FIG. 6. The oil 101 soaks into the surface to a certain depth, mainly via thus narrowed tracheid T, thereby forming the oil impregnated portion P. Thus, the oil 101 that soaks into the surface layer of the wooden piece 1 remains inside the tracheid T even after the wooden piece 1 is dried. When the wooden piece 1 is taken from hardwood (such as paulownia or zelkova), the vessel plays the role of the tracheid T described above.

In order, to make the oil 101 soak into the wooden piece 1 during the compression process, the oil 101 is required to have a suitable boiling point so that the oil 101 does not evaporate in the above-described water vapor atmosphere. Since the upper limit of the temperature of the water vapor atmosphere is approximately 230° C., the boiling point of the oil 101 is required to be equal to or higher than 230° C. In addition, the oil 101 must be in liquid state at the temperature of approximately 5 to 35° C. (room temperature). Oils that satisfy the above conditions are, for example, silicone oil, engine oil, and lubricating oil. These types, of oil are known to be in liquid sate at a room temperature and to have the boiling point over at least 260° C.

After the wooden piece 1 is compressed for a predetermined time period (one to dozens of minutes, or more preferably approximately 5 to 10 minutes), the water vapor atmosphere is removed, to dry the wooden piece 1. Then, the metal molds 51 and 61 are separated from each other so that the wooden piece 1 is released from compression. Thus, the compression process is completed. As a result of the compression process, the thickness of the wooden piece 1 becomes approximately 30 to 50% of the thickness before the compression.

Generally, the wooden piece released from compression is subjected to a stress which makes the wooden piece recover its original shape. In the present embodiment, an adhesion of the surface (external face) of the wooden piece 1 to the surface of the depression 62 of the metal mold 61 is closer than the adhesion of the surface (internal face) of the wooden piece 1 to the protrusion 52 of the metal mold 51. Hence, even after the metal mold 51 is raised, the wooden piece 1 may well remain in close contact with the metal mold 61. In the present embodiment, however, since the oil 101 is applied to the surface of the depression 62, the wooden piece 1 can be easily separated from the metal mold 61, and the surface of the wooden piece 1 is less likely to be scratched and damaged during separation.

For the compression process described above, an appropriate driving unit may be provided to electrically drive the metal mold 51 to realize vertical movement of the metal mold 51 relative to the metal mold 61. Alternatively, the metal molds 51 and 61 may be connected with each other by a screw, so that the vertical movement of the metal mold 51 relative to the metal mold 61 can be realized with manual or automatic screwing.

When the wooden piece 1 obtained as a result of the compression process has unevenness or forming error on an edge surface or the like, an appropriate post-processing may be performed on the edge surface by cutting or grinding, for example.

Figure 7:
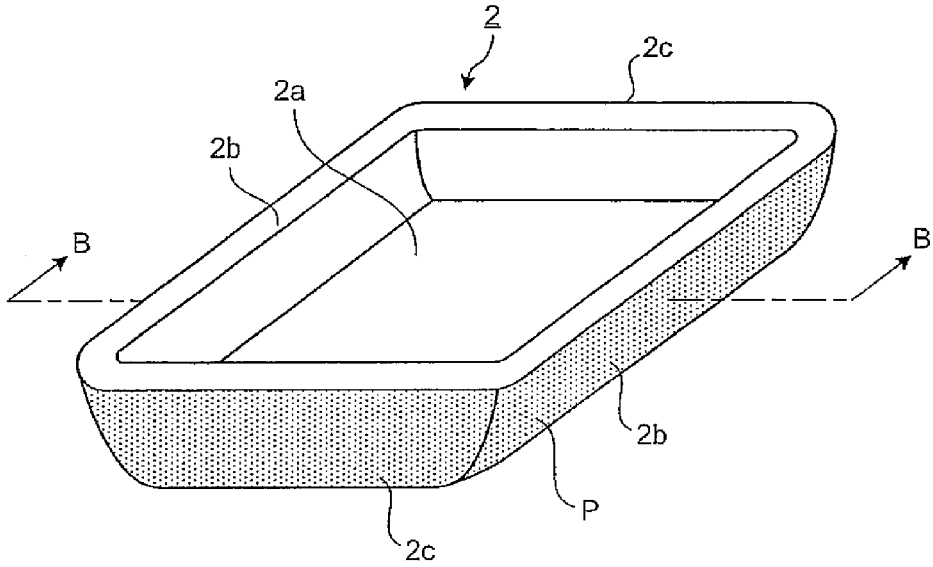
FIG. 7 is a perspective view of a configuration of the compressed wood product according to the first embodiment of the present invention.
Figure 8:
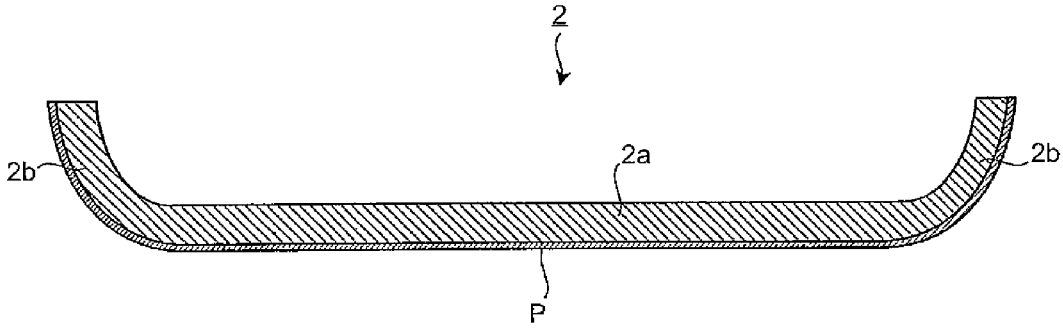
FIG. 8 is a sectional view taken, along line B-B of FIG. 7.

FIG. 7 is a perspective view of a configuration of a compressed wood product manufactured by the method of processing wood according to the first embodiment. FIG. 8 is a schematic vertical sectional view of a section, taken along line B-B of FIG. 7. A compressed wood product 2 shown in FIGS. 7 and 8 includes a main plate portion 2*a*, two side plate portions 2*b*, and two side plate portions 2*c* corresponding respectively to the main plate portion 1*a*, two side plate portions, 1*b*, and two side plate portions 1*c* of the wooden piece 1. Further, the compressed wood product 2 has an oil impregnated portion P formed by the oil 101 on a curved external face extending from the main plate portion 2*a* to the side plate portions 2*b* and 2*c*. The depth of the oil impregnated portion P varies depending on the thickness and the compression rate of the compressed wood product 2, the density of the wooden piece, and the like. Preferably, the process is performed so that the oil soaks in deeper than a depth of a possible scratch which may be formed during the use of the compressed wood product.

In FIG. 8, the oil impregnated portion P is illustrated as a separated part from the wooden piece. The oil impregnated portion P is shown as such merely because FIG. 8 is a schematic drawing. Needless to say, the actual oil impregnated portion P is formed through soak of the oil 101 into the vessels or the tracheids surrounded by the cell wall as described with reference to FIGS. 5 and 6.

Figure 9:
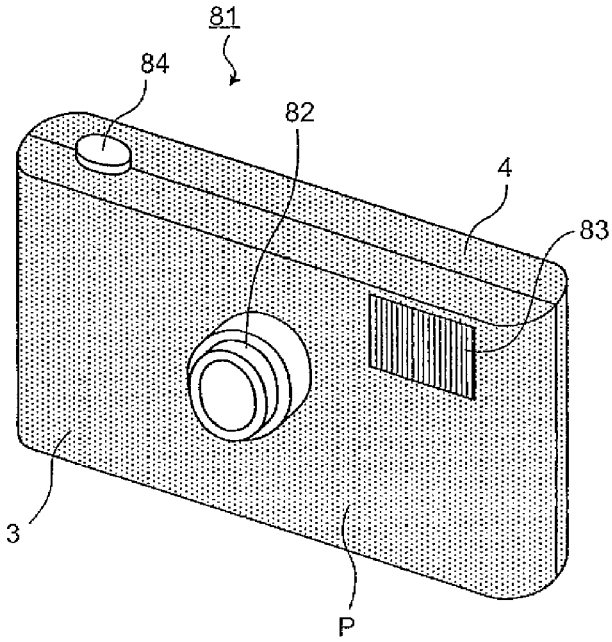
FIG. 9 is a perspective view of an outer appearance of a digital camera which includes the compressed wood products of the first embodiment of the present invention as jacket materials.

FIG. 9 shows an example of application of the compressed wood product 2, and more specifically is a perspective view of an outer appearance of a digital camera covered by cover members formed from the compressed wood products 2. A digital camera 81 shown in FIG. 9 includes an image pick-up unit 82 having an imaging lens, a photoflash 83, and a shutter button 84, and is covered by two cover members 3 and 4. Inside the digital camera 81, various electronic components and optical components (not shown) are housed to realize functions of the digital camera 81. Housed components are, for example, a control circuit that includes a central processing unit (CPU) for performing drive control related to image pick-up process or other various operations, a solid-state image sensing device such as a charge coupled device (CCD) or a complementary metal-oxide semiconductor (CMOS), an audio input/output device such as microphone or speaker, and a drive circuit that drives each functioning component under control by the control circuit.

Figure 10:
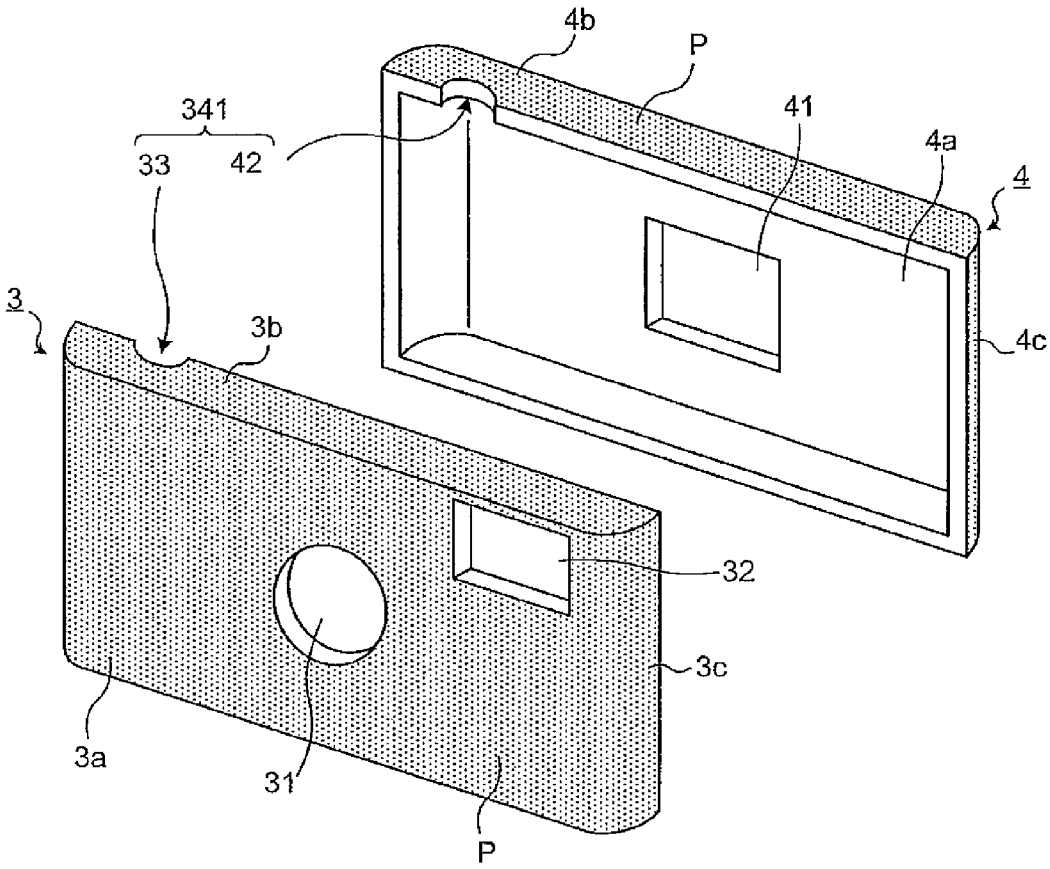
FIG. 10 is a perspective view of a configuration of cover members that are employed as jackets for the digital camera of FIG. 9.

FIG. 10 is a perspective view showing a schematic configuration of the cover members 3 and 4 that are jacket materials of the digital camera 81. Of the cover members 3; and 4, the cover member 3 which covers a front side of the digital camera 81 includes a substantially rectangular main plate portion 3*a*, and side plate portions 3*b* and 3*c* corresponding respectively to the main plate portion 2*a*, and the side plate portions 2*b* and 2*c* of the compressed wood product 2. In the main plate portion 3*a*, a circular opening 31 which exposes the image pick-up unit 82 and a rectangular opening 32 which exposes the photoflash 83 are formed. Further, a semi-circular cut-out portion 33 is formed in the side, plate portion 3*b*.

On the other hand, the cover member 4 that covers a rear side of the digital camera 81 has a main plate portion 4*a*, side plate portions 4*b* and 4*c* corresponding respectively to the main plate portion 2*a*, the side plate portions 2*b* and 2*c* of the compressed wood product 2. The main plate portion 4*a* has a rectangular opening 41 to expose a display unit (not shown) realized by a liquid crystal display, a plasma display, or an organic electroluminescence (EL) display to display image information and text information. Further, the side plate portion 4*b* has a semi-circular cut-out portion 42. When the cover members 3 and 4 are joined together, the semi-circular cut-out portion 42 is joined together with the cut-out portion 33 of the cover member 3 to form an opening 341 to expose the shutter button 84. Each of the cover members 3 and 4 have a substantially uniform thickness, and the oil impregnated portion P is formed on the external face of each cover member (shown as dotted area).

The openings and the cut-out portions of the cover members 3 and 4 may be formed simultaneously with the cutting-out of the wooden piece 1, which is later processed into the cover members 3 and 4, from the raw wood 10. Alternatively, the openings and the cut-out portions may be formed after the compression process of the wooden piece 1 by technique such as cutting and drilling. Further, the cover member 3 or 4 may have an additional opening or cut-out portion for an attachment of a finder, for exposing input keys through which the user gives instruction signals for operation, or for exposing a connection interface (such as DC input terminal or USB connecting terminal) for an external device. Still further the cover member 3 or 4 may have an audio output hole consisting of plural small holes, through which sound from the embedded speaker of the digital camera 81 can be heard.

When a coated surface of the wooden, piece is scratched, a coating layer is stripped off. Then, moisture permeates into the wooden piece from the scratch, thereby degrading the wooden piece and deteriorating the durability thereof. One conventionally proposed treatment technique of wood surface intends to eliminate such problem by improving the durability or the like of the wooden piece through modification of the property of the wood surface. For example, Japanese Patent Application Laid-Open No. 2003-73608 Publication discloses a technique to impregnate a solvent-free molten material, which is prepared for impregnation into the wooden piece and is in solid state at room temperature, into the wooden piece by application of heat and pressure.

According to the conventional technique described in Japanese Patent Application Laid-Open No. 2003-73608 Publication, since the molten material which is in solid state at room temperature is impregnated into the wooden piece, even when the surface of the wooden piece is scratched, the permeation of moisture or the like therethrough can be suppressed, whereby the durability of the wooden piece can be maintained. According to the conventional technique, however, since the wooden piece is immersed into the molten material melted by heat for the impregnation thereof, the surface of the wooden piece is covered by the layer of the molten material. As a result, a unique feeling to wood is lost similarly to the coated wooden piece.

On the other hand, according to the first embodiment, when the wooden piece cut out from the raw wood is processed into the three-dimensional shape by the pair of metal molds, oil is applied to the surface of at least one of the metal molds, the surface of which comes into contact with the surface of the wooden piece. The oil is in liquid state at the temperature of 5 to 35° C. and has a boiling point equal to or higher than 230° C. The wooden piece is sandwiched and compressed by the pair of metal molds, to one of which the oil is applied. Thus, the unique feeling of the wooden piece remains after the process and the strength and the durability of the wooden piece can be improved.

According to the first embodiment of the present invention as described above, when the wooden piece is processed by the pair of metal molds, property granting liquid (oil) is applied to the surface of at least one of the metal molds, the surface of which comes into contact with the surface of the wooden piece. The property granting liquid (oil) is in liquid state at the temperature of 5 to 35° C., and grants a certain property to the surface of the wooden piece. The wooden piece is sandwiched and compressed by the pair of metal molds, to one of which the property granting liquid is applied. Thus, a desired property can be readily granted to the wooden piece subjected, to compression.

Further, according to the first embodiment, substances such as air and moisture are restrained from getting, in and out of the surface of the oil impregnated portion. Hence, it is possible to prevent deformation due to swelling of the wooden piece or corrosion of wooden fibers caused by permeation of moisture, and to prevent the defacement of the wooden piece caused by the intrusion/of dirt. In addition, since the oil impregnated portion is formed in view of the depth of possible scratch suffered from out side, even if the surface of the wooden piece is scratched, the oil is not separated from the wooden piece, whereby the strength and the durability of the wooden piece can be maintained.

Still further, according to the first embodiment, the wooden piece is adhered to the smooth surfaces of the metal molds at the compression process, and the oil impregnated portion is formed at the surface layer of such wooden piece. Hence, the obtained wooden piece has excellent smoothness and luster on the surface. Therefore, the surface of the obtained wooden piece is favorable for jacket materials of industrial products even without a separate coating process. In addition, since the surface is not covered with a coating layer of resin or wax, no additional process such as surface polishing is required for removal of molten material on the surface, and the unique feeling of the wooden piece, such as touch, color, and texture can be maintained.

In the above description, the oil 101 is applied to the surface of the depression 62 of the metal mold 61 in the oil application process, followed by the formation of the oil impregnated portion P on the external face of the wooden piece 1 in the compression process. Alternatively, the oil 101 may be applied to the surface of the protrusion 52 of the metal mold 51, so that the oil impregnated portion is formed on the internal face of the wooden piece 1 in the compression process.

Still further, oil of the same type or different type may be applied to each of the protrusion 52 of the metal mold 51 and the depression 62 of the metal mold 61 in the oil application process, so that the oil impregnated portion is formed on both of the internal face and the external face of the wooden piece 1.

A second embodiment of the present invention intends to supplement a lost property or to add a new property to the wooden piece by impregnating essential, oil, which serves as the property granting liquid, of same type as or different type from the essential oil of the wooden piece into the surface of the wooden piece subjected to compression. Here, the supplemented or added property is a property attributable to sap components contained in the wooden piece. According to a method of processing wood of the second embodiment, a wooden piece of a predetermined shape is cut out from the raw wood (cutting-out process). The cutting-out process of the second embodiment is the same as the cutting-out process of the first embodiment. In the second embodiment, the dish-like wooden piece 1 is cut out from the raw wood 10 in a similar manner (see FIG. 1).

Figure 11:
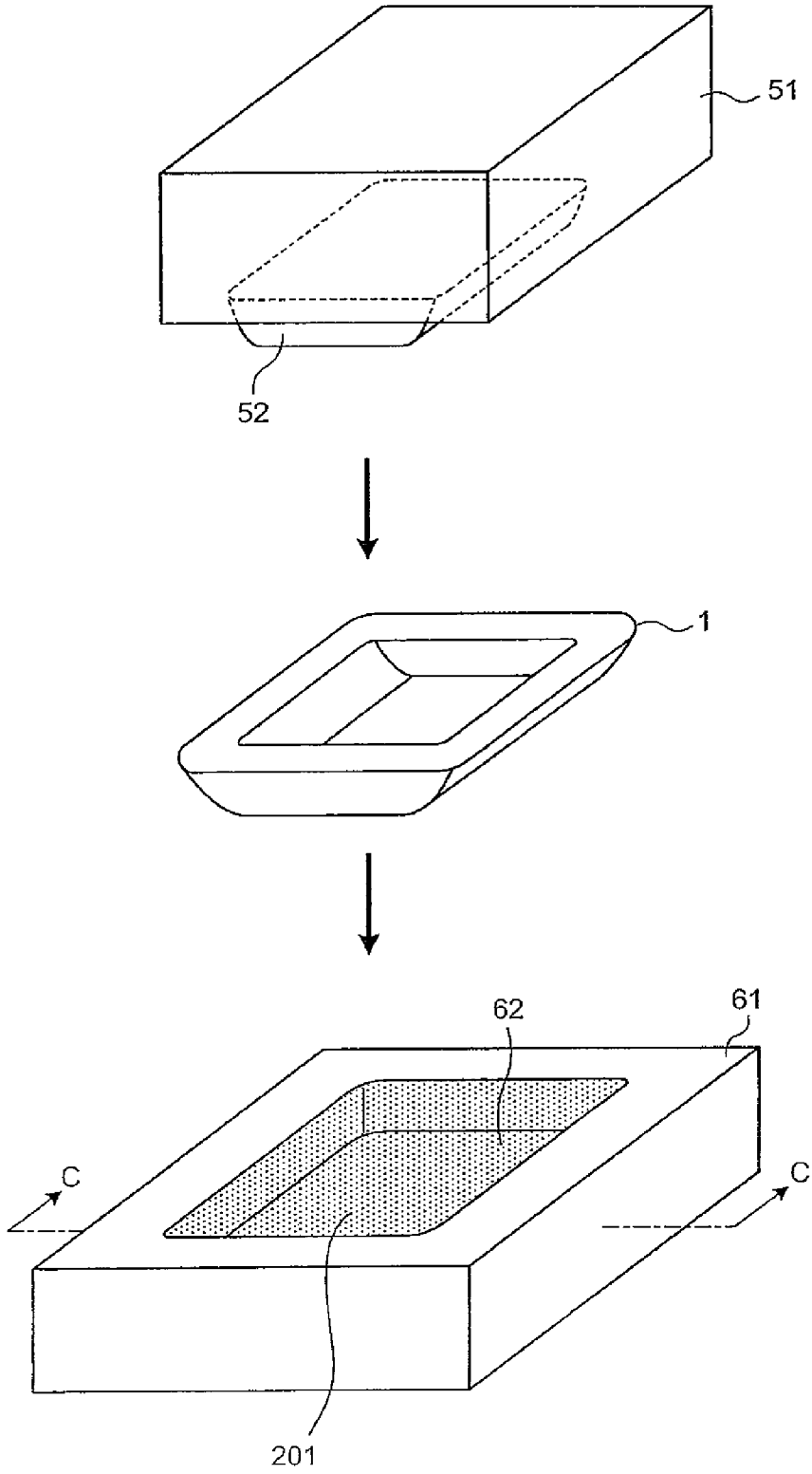
FIG. 11 shows a configuration of metal molds used in a method of processing wood according to a second embodiment of the present invention and a wooden piece before compression.
Figure 12:
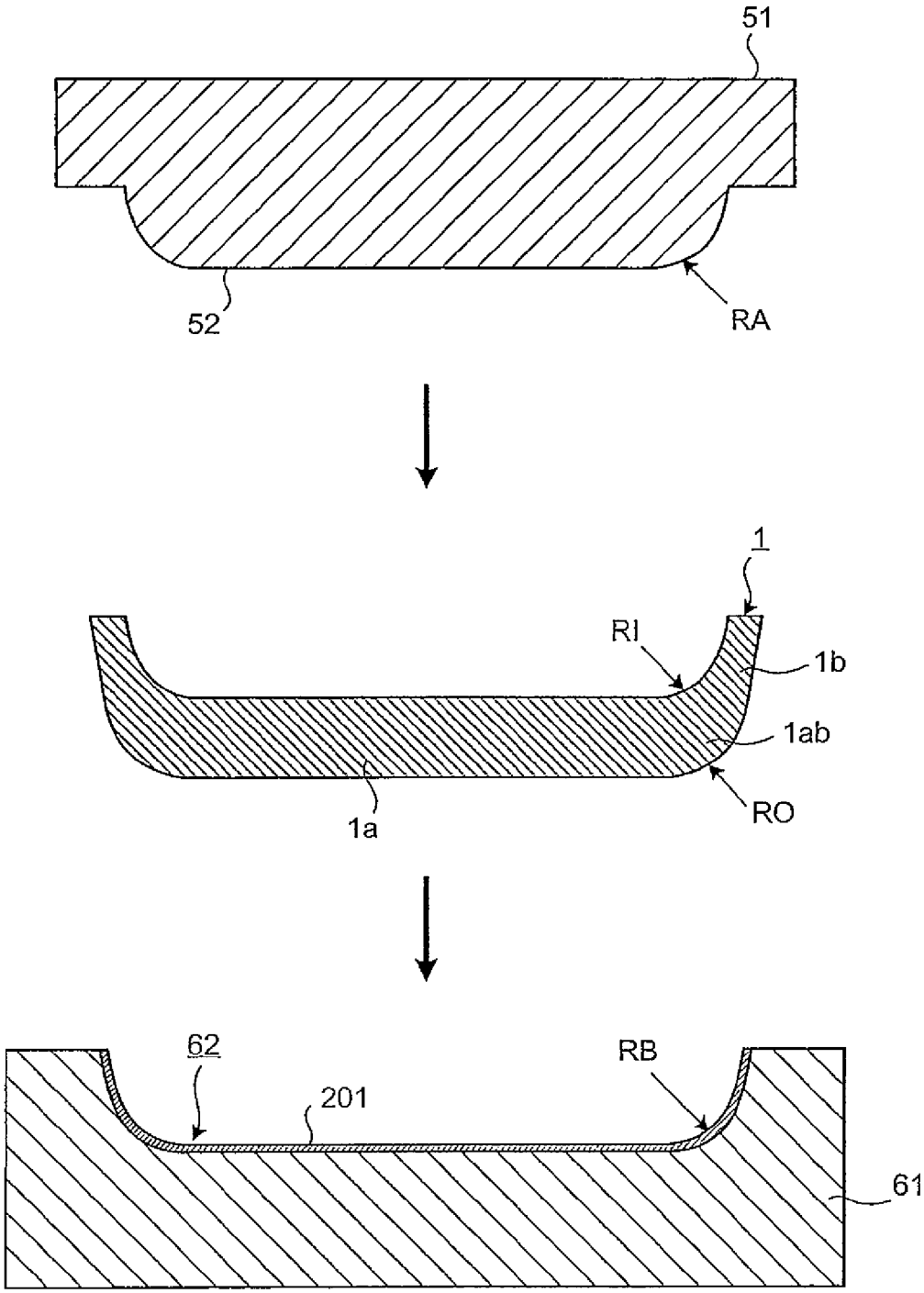
FIG. 12 is a sectional view taken along line C-C of FIG. 11.

FIG. 11 shows a configuration of metal molds used in the method of processing wood according to the second embodiment and a wooden piece 1 before compression. FIG. 12 is a sectional view taken along line C-C of FIG. 11. As shown in FIGS. 11 and 12, the wooden piece 1 is sandwiched and compressed by the same pair of metal molds 51 and 61 as used in the first embodiment. An essential oil containing liquid 201 is applied on a surface of the depression 62 of the metal mold 61 (i.e., metal mold surface that comes into contact with the outer surface of the dish-like wooden piece 1) of the pair of metal molds. The essential oil containing liquid 201 is applied to the surface of the depression 62 while at a room temperature (approximately 5 to 35° C.) or higher (up to approximately 100° C.) before the wooden piece 1 is placed between the metal molds 51 and 61 (essential oil containing liquid application process).

It is sufficient that the essential oil containing liquid 201 is in liquid state at least at the application thereof to the surface of the depression 62. If so, the essential oil containing liquid 201 can be applied to the surface of the depression 62 by a brush, a roller, or a spray, whereby the essential oil containing liquid application process can be performed easily and speedily. Hence, the essential oil containing liquid 201 may be a solution of essential oil in a solvent which is in liquid state at a certain temperature, or a dispersion of essential oil in a dispersion medium which is in liquid state at a certain temperature.

Here, the certain temperature means the temperature of the essential oil containing liquid 201 when applied to the depression 62, which is generally approximately 5 to 35° C., though being possibly approximately 100° C. on the metal mold after used in the compression process described later).

Examples of the essential oil containing liquid 201 are as follows. First, α-pinene, which is essential oil contained in sap component of Japanese cypress and red pine, is in liquid state at the room temperature and has a melting point of −57° C. Hence, α-pinene can be the essential oil containing liquid 201 by itself. On the other hand, hinokiol, which is an essential oil contained in the sap component of Japanese cypress, is in solid state at the room temperature and has a melting point of 234 to 235° C. Hence, hinokiol alone cannot serve as the essential oil containing liquid 201. However, when dissolved in ethanol, ether, acetone, chloroform or the like, resulting solution of hinokiol in one of these, solvents can be used as the essential oil containing liquid 201.

Following the essential oil containing liquid application process as described above, the wooden piece 1 is compressed by the metal molds 51 and 61 (compression process). The compression process of the second embodiment is similar to the compression process of the first embodiment described above. The wooden piece 1 is left in the water vapor atmosphere of high temperature and high pressure, for a predetermined time period as described above to be softened. Then, the softened wooden piece 1 is placed at a predetermined position, and the metal mold 51 is lowered so that the wooden piece 1 is sandwiched between the metal molds 51 and 61. Thus, a predetermined amount of compressive force is applied to the sandwiched wooden piece 1. Thus, the wooden piece 1 receives compressive force from the metal molds 51 and 61, so as to be deformed into the three dimensional shape corresponding to the shape of the gap between the metal molds 51 and 61 similarly to the first embodiment shown in FIG. 4. At this time, essential oil which constitutes at least a part of the essential oil containing liquid 201 applied to the surface of the depression 62 gradually soaks into the external face of the wooden piece 1 due to the application of compressive force. Thus, an essential oil impregnated portion Q is formed on the surface layer of the external face of the wooden-piece 1.

Figure 13:
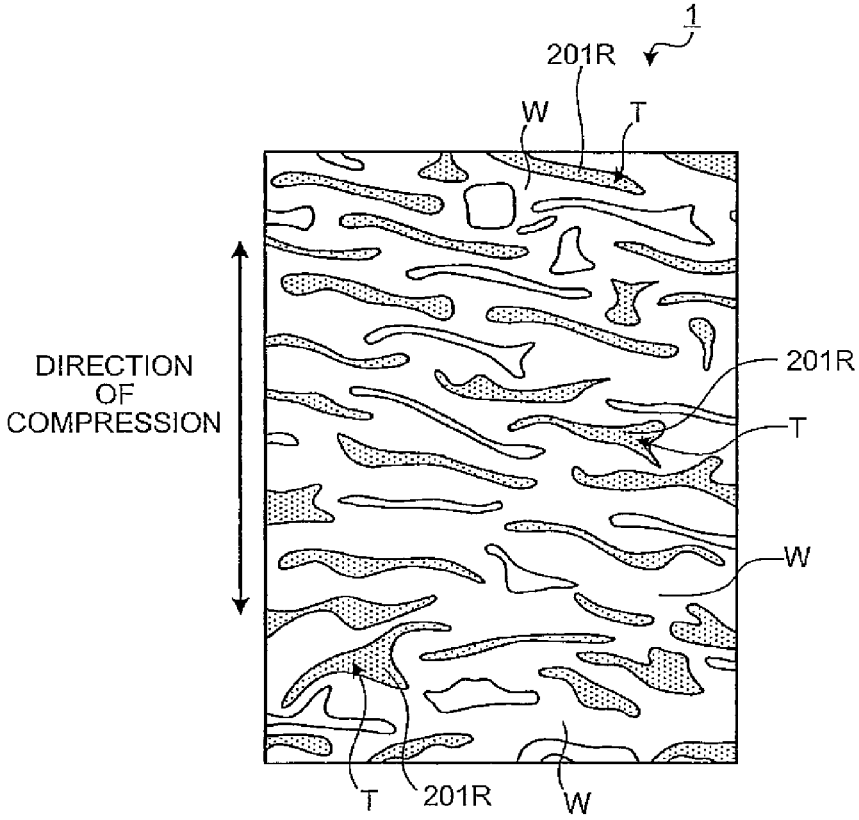
FIG. 13 schematically shows a configuration of a section of the wooden piece in a direction perpendicular to the direction of wooden fibers in the wooden piece after compressed into the compressed wood product by the method of processing wood according to the second embodiment of the present invention

FIG. 13 schematically shows a portion of the surface layer of the wooden piece 1 after the soak of essential oil. More specifically, FIG. 13 schematically shows, a section perpendicular to the direction L of wooden fibers in the surface layer of the wooden piece 1 after the compression, wherein the wooden piece is taken from softwood (such as Japanese cypress, or hiba cedar). The portion of the surface layer of the wooden piece 1 before the compression is as schematically shown, in FIG. 5. After the compression, as shown in FIG. 13, the cell wall W is pressed in the direction of compression, and the openings of the tracheids T become narrower. Essential oil 201R which constitutes at least a part of the essential oil containing liquid 201 soaks into the surface of the wooden piece 1 to a certain depth mainly through the narrowed tracheids T, thereby forming the essential oil impregnated portion Q. Therefore, the essential oil 201R that soaks into the surface layer of the wooden piece 1 remains inside the tracheids T even after the wooden piece 1 is dried.

In order to make the essential oil 201R soaks into the wooden piece 1 as described above, the essential oil 201R is required to have a suitable boiling point so that the essential oil 201R does not evaporate even in the above described water vapor atmosphere. Since the temperature of the water vapor atmosphere is approximately 100 to 230° C. as described above, the essential oil 201R must be in liquid state even in the water, vapor atmosphere of such a high temperature. Since the pressure of the water vapor, atmosphere is higher than the pressure of atmospheric air, the boiling point of the essential oil 201R in the water vapor atmosphere is higher than the boiling point in the atmospheric air pressure. For example, assume that the α-pinene is employed as the essential oil containing liquid 201, i.e., assume that, the essential oil 201R is α-pinene. The boiling point of α-pinene in the atmospheric air pressure is known to be 155 to 156° C. In the above described water vapor atmosphere, however, the boiling point may be higher than that in the atmospheric air pressure by a few degrees to a several tens of degrees. Hence, if the species of the wooden piece 1 is properly selected and the pressure of the water vapor atmosphere is properly set, the essential oil 201R can be maintained in liquid state during the compression process.

When the hinokiol solution is employed as the essential oil containing liquid 201, the solvent such as ethanol mentioned above may evaporate in the water vapor atmosphere. However, since the hinokiol itself has the boiling point of 240 to 247° C. even in the atmospheric air pressure, the hinokiol remains in liquid state or solid state. Even if hinokiol is in solid state at the compression, hinokiol still soaks into the surface layer of the wooden piece 1 by the application of compressive force.

Here, α-pinene and hinokiol are both essential oil contained in Japanese cypress. Japanese cypress contains monoterpene represented by α-pinene and sesquiterpene represented by hinokiol. Synergy effect of various types of terpenes gives fragrance as well as antibacterial property, to Japanese cypress. Hence, Japanese cypress has been known as an excellent building timber with high durability since ancient times. In view of such property, of Japanese cypress, the property, such as fragrance and antibacterial property of Japanese cypress may be added to the wooden piece 1 taken from other species of wood than Japanese cypress when the essential oil containing liquid 201, for example, a mixture of α-pinene and hinokiol (and solvent), is impregnated into the wooden piece 1. Hence, it may be possible to manufacture a Japanese-cypress-like quality compressed wood product at low cost if a less expensive and readily available wooden piece such as Japanese cedar is treated as described above.

When the wooden piece 1 is taken from Japanese cedar, the essential oil containing liquid 201 may be prepared as a mixture of sap components of Japanese cedar, such as cryptomeriol, cryptomeridiol, δ-cadinene, and β-eudesmol; in addition to α-pinene and hinokiol mentioned above. Then, if the essential oil contained in the wooden piece 1 is reduced or lost while the wooden piece 1 is left in the water vapor atmosphere or subjected to compression, the lost or reduced amount of essential oil can be supplemented so that the wooden piece 1 can recover its inherent property.

Some representative properties attributable to the sap component of the wood and types of wood having such properties are listed below. Wood having antibacterial property similarly to Japanese cypress is hiba cedar, sawara cypress, Japanese arbor-vitae, Taiwan cypress, eucalyptus, for example. Wood such as camphor, satinwood, eucalyptus, is known to have mothproof property. Some types of wood have a property to kill specific insects such as tick (i.e., antitick property), for example, Japanese cypress, hiba cedar, sawara cypress, Japanese cedar, red pine, Alaskan yellow, cedar, western redcedar. Wood with antitermite property is Japanese cypress, hiba cedar, sawara cypress, Japanese umbrella pine, large-leaved podocarp, satinwood. When the essential oil containing liquid is prepared as an appropriate mixture of the essential oils contained in these various types of wood, a desired property can be added to or recovered in the wooden piece 1.

The essential oils having the above described various properties are, in addition to α-pinene and hinokiol, hinokitiol, camphor, camphene, γ-cadinene, α-cadinol, δ-cadinol, cuparene, bornyl acetate, safrole, cineole, cedrene, cedrol, thujopsene, dolabfin, fenchene, borneol, limonene, for example.

Wood has various properties other than those described above (for example, deodorizing, mildew resistance, human health enhancement), and various types of essential oils are known to possess such properties. In this sense, the essential oils, applicable to the present embodiment are not limited to those described above.

When the essential oil to be mixed in the essential oil containing liquid 201 is to be extracted from the sap component of wood, appropriate manner of extraction is adopted depending on the characteristics of the essential oil to be extracted. For example, technique such as elution, pressing, centrifugation, dry distillation can be adopted. When the chemical composition of the essential oil is identified and artificially preparable, chemically purified essential oil may be adopted.

The wooden piece 1 is compressed for a predetermined time period (one to dozens of minutes, more preferably approximately 5 to 10 minutes) in the compression process. Then, the water vapor atmosphere is removed to dry the wooden piece 1, and the metal molds 51 and 61 are separated from each, other so that the wooden piece 1 is released from the compression. As a result, the thickness of the wooden piece 1 becomes approximately 30 to 50% of the thickness before the compression process.

Figure 14:
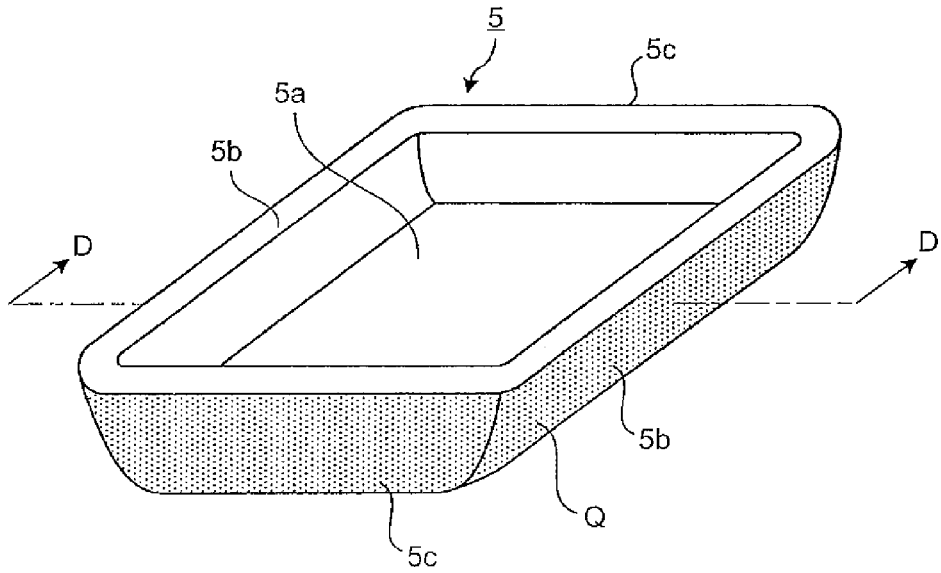
FIG. 14 is a perspective view of a configuration of a compressed wood product manufactured by the method of processing wood according to the second embodiment of the present invention.
Figure 15:
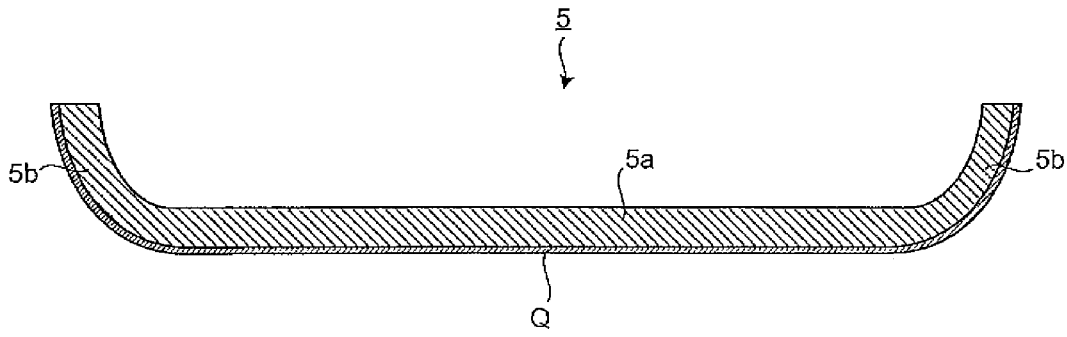
FIG. 15 is a sectional view taken along line D-D of FIG. 14.

FIG. 14 is a perspective view of a configuration of a compressed wood product manufactured by the method of processing wood according to the second embodiment. FIG. 15 is a schematic vertical sectional view of a section taken along line D-D of FIG. 14. The compressed wood product 5 shown in FIGS. 14 and 15 includes a main plate portion 5*a*, two side plate portions 5*b*, and two side plate portions 5*c* corresponding respectively to the main plate portion 1*a*, two side plate portions 1*b*, and two side plate, portions 1*c* of the wooden piece 1. Further, the essential oil impregnated portion Q is formed by the essential oil 201R on the curved external face extending from the main plate portion 5*a* to the side plate portions 5*b* and 5*c*. The depth of the essential oil impregnated portion Q varies depending on the thickness and the compression rate of the compressed wood product 5 and the density of the wooden piece, or the like. For example, preferably the depth of the essential oil impregnated portion Q is set deeper than the depth of possible scratch which may be formed during use of the compressed wood product 5, so that the scratch would not degrade the property granted by the essential oil 201R.

In FIG. 15, the essential oil impregnated portion Q is illustrated as a separate part from the wooden piece. The essential oil impregnated portion Q is shown as such merely because FIG. 15 is a schematic drawing. Needless to say, the actual essential oil impregnated portion Q is formed through soak of the essential oil 201R into the tracheids (or the vessels) surrounded by the cell wall as described with reference to FIG. 13.

Figure 16:
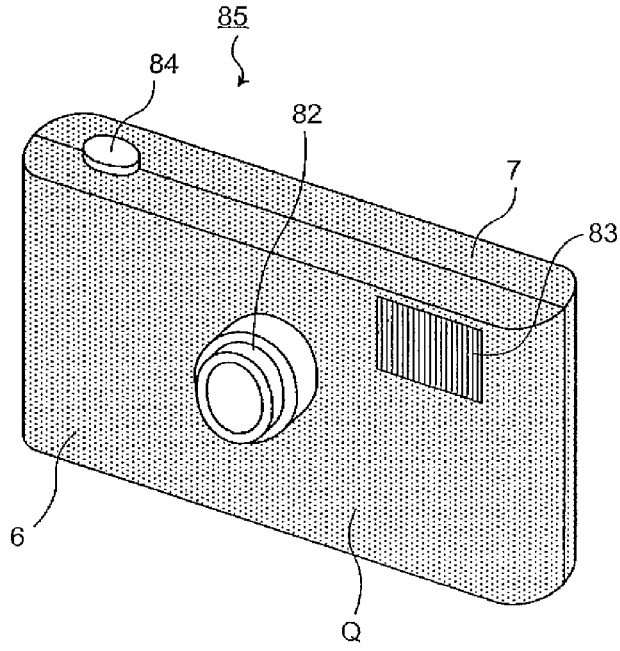
FIG. 16 is a perspective view of an outer, appearance of a digital camera which includes the compressed wood products manufactured by the method of processing wood according to the second embodiment of the present invention as jacket materials.

FIG. 16 shows an example of application of the compressed wood product 5. More specifically, FIG. 16 is a perspective view of an outer appearance of a digital camera covered by cover members formed from the compressed wood products 5. A digital camera 85 shown in FIG. 16, similarly to the digital camera 81 of the first embodiment described above, includes the image pick-up unit 82, the photoflash 83, and the shutter button 84, and is covered by two cover members 6 and 7. The essential oil impregnated portion Q is formed on the external face of each of the cover members 6 and 7 (shown as dotted area).

The configuration of the cover member 6 is the same as the configuration of the cover member 3 except that the essential oil impregnated portion Q is formed in place of the oil impregnated portion P (see FIG. 10). Similarly, the configuration of the cover member 7 is the same as the configuration of the cover member 4 except that the essential oil impregnated portion Q is formed in place of the oil impregnated portion P. Further, a detailed configuration including the inner configuration of the digital camera 85 is the same as that of the digital camera 81 of the first embodiment described above.

According to the conventional technique of compression, the wooden piece shaped out from the raw wood is left in the water vapor atmosphere of high temperature and high pressure for a predetermined time period to be softened. During this process, moisture permeates into the wooden piece to cause elution of sap component inside the wooden piece to the moisture, or to cause evaporation thereof into the air. In addition, when the compression as described above follows the softening of the wooden piece, the space inside the wooden fibers narrows, thereby causing outflow of sap component remaining inside the wooden piece together with the moisture contained in the wooden piece to the outside. Thus, when the wooden piece is processed by the conventional technique of compression, sap component inherently contained in the wooden piece before the compression may be reduced or lost after the compression.

The sap components of wood include essential oil which has properties such as antibacterial property or mothproof property in addition to the fragrance depending on the type of wood. When the sap component containing such essential oil is reduced or lost from the wooden piece due to the compression, an inherent characteristic of the wood attributable to the sap component thereof may be lost.

In addition, since the types of the essential oil vary according to the types of wood, a specific property of a certain type of wood cannot be granted to wood of a different type.

According to the second embodiment, when the wooden piece is processed into the three-dimensional shape by the pair of metal molds, the essential oil containing liquid application process and the compression process are performed. In the essential oil containing liquid application process, the essential oil containing liquid is applied to the surface of at least one of the metal molds, the surface of which comes into contact with the surface of the wooden piece. The essential oil containing liquid contains the essential oil and is in liquid state at temperatures of 5 to 35° C. In the compression process, the wooden piece is sandwiched and compressed by the pair of metal molds including the metal mold, to which the essential oil containing liquid is applied, in the water vapor atmosphere of higher temperature and pressure than those in the atmospheric air. The essential oil is in liquid state or solid state in the water vapor atmosphere of the compression process. Therefore, it is possible to prevent the property of the wooden piece attributable to the sap component in the wooden piece from being lost or reduced by the compression and further to add the property attributable to the sap component included in a different type of wood from the wood to be processed to the wooden piece.

According to the second embodiment of the present invention as described above, when the wooden piece is processed by the pair of metal molds, the property granting liquid (essential oil containing liquid) is applied to the surface of at least one of the metal molds, the surface of which comes into contact with the surface of the wooden piece. The property granting liquid is in liquid state at temperatures of 5 to 35° C., and grants a certain property to the surface of the wooden piece. The wooden piece is sandwiched and compressed by the pair of metal molds, to one of which the property granting liquid is applied. Therefore, a desired property can be readily granted to the wooden piece subjected to compression.

Specifically, according to the second embodiment, as well as the wooden piece is prevented from losing its original property by the impregnation of essential oil inherently contained in the sap component of the wooden piece to be processed, the property of different type of wood can be added to the wooden piece to be processed by impregnation of essential oil contained in the sap component of a different type of wood. Therefore, a desired property can be granted to the wooden piece to be processed by using a mixture of plural types of essential oils.

Still further, according to the second embodiment, the external face of the wooden piece having a dish-like three-dimensional shape is adhered to the smooth surfaces of the metal molds in the compression process, and the essential oil impregnated portion is formed at the surface layer of the compressed wooden piece abutting the metal molds. Hence, the obtained wooden piece has excellent smoothness and luster on the surface. Therefore, the surface of the obtained wooden piece is favorable for jacket materials of industrial products even without a separate coating process. In addition, since the surface is not covered with a coating layer of resin or wax, no additional process such as surface polishing is required for removal of molten material on the surface, and the unique feeling of the wooden piece, such as touch, color, and texture can be maintained.

In the above description, the essential oil containing liquid 201 is applied to the surface of the depression 62 of the metal mold 61 in the essential oil containing liquid application process, followed by the formation of the essential oil impregnated portion Q on the external face of the wooden piece 1 in the compression process. Alternatively, the essential oil containing liquid 201 may be applied to the surface of the protrusion 52 of the metal mold 51, so that the essential oil impregnated portion can be formed on the internal face of the wooden piece 1 in the compression process.

Still further, essential oil of the same type or different type may be applied to each of the protrusion 52 of the metal mold 51 and the depression 62 of the metal mold 61 in the essential oil containing liquid application process, so that the essential oil impregnated portion is formed on both of the internal face and the external face of the wooden piece 1.

A third embodiment of the present, invention intends to improve the flame retardance of the wooden piece by impregnation of flame-retardant liquid as the property granting liquid to the surface of the wooden piece subjected to the compression. In the method of processing wood according to the third embodiment, first, a wooden piece of a predetermined shape is cut out from raw wood (cutting-out process). The cutting-out process of the third embodiment is the same as the cutting-out process of the first embodiment. Similarly to the first embodiment, the dish-like wooden piece 1 is cut out from the raw wood 10 in the third embodiment (see FIG. 1).

Figure 17:
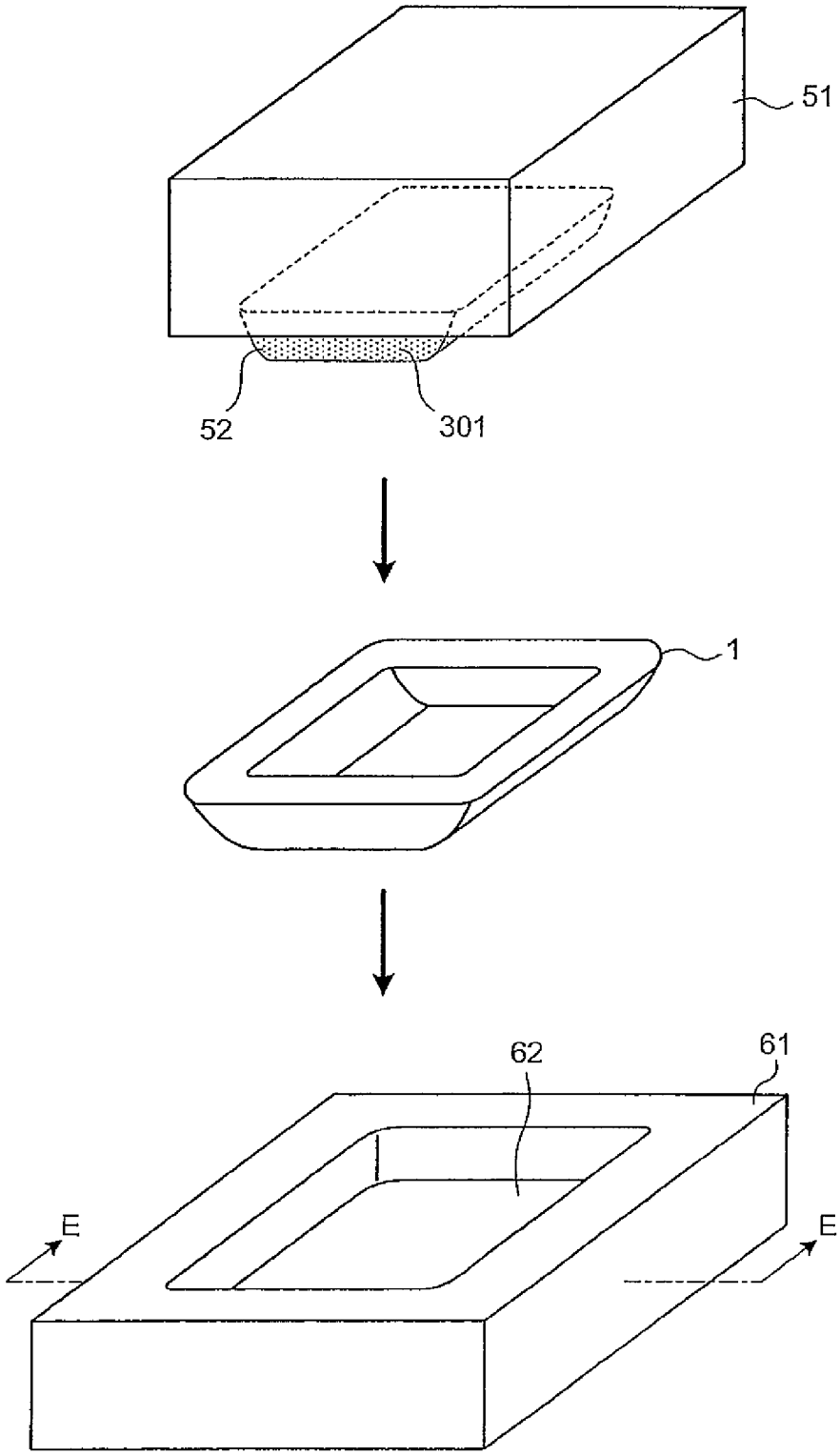
FIG. 17 shows a configuration of metal molds used in the method of processing wood according to a third embodiment of the present invention and a wooden piece before compression.
Figure 18:
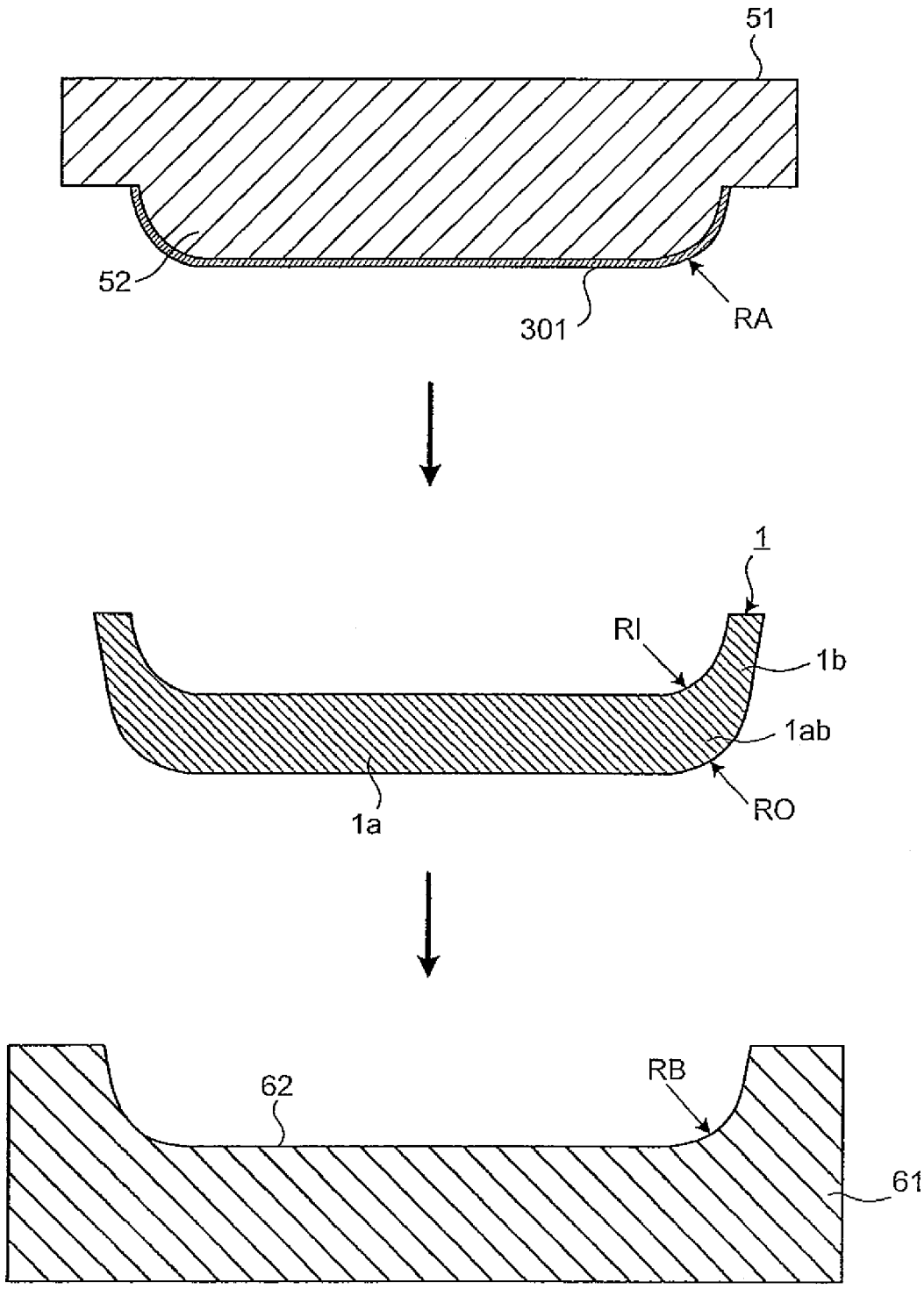
FIG. 18 is a sectional view taken along line E-E of FIG. 17.

FIG. 17 shows a configuration of metal molds used in the method of compressing wood according to the third embodiment and the wooden piece 1 before compression, and FIG. 18 is a sectional view taken along line E-E of FIG. 17. As shown in FIGS. 17 and 18, the wooden piece 1 is sandwiched and compressed by the same pair of metal molds 51 and 61 as used in the first embodiment. A flame-retardant liquid 301, which enhances the flame retardance of wood, is applied on the surface of the protrusion 52 of the metal mold 51 (a surface of the metal mold that comes into contact with the inner surface of the dish-like wooden piece 1) of the pair of metal molds.

In the method of processing wood according to the third embodiment, the flame-retardant liquid 301 is applied to the surface of the protrusion 52 of the metal mold 51 while at a room temperature (approximately 5 to 35° C.) or higher (up to approximately 100° C.) before the wooden piece 1 is sandwiched between the metal molds 51 and 61 having the above described configuration (flame-retardant liquid application process). It is sufficient that the flame-retardant liquid 301 is in liquid state at least when applied to the surface of the protrusion 52. Then, the flame-retardant liquid 301 can be applied to the surface of the protrusion 52 by a brush, a roller, or a spray, whereby the flame-retardant liquid application process can be performed easily and speedily.

Specifically, the flame-retardant liquid 301 is a water solution of generally used flame retardant, such as boron-based compound (such as pyroborate, boric acid, sodium octaborate), ammonium salt (such as dibasic ammonium phosphate, ammonium sulfate), and guanidine sulfamate.

In the description above, the flame-retardant liquid 301 is applied to the protrusion 52 of the metal mold 51. The flame-retardant liquid 301 may be, however, applied to the depression 62 of the metal mold 61. Further, the flame-retardant liquid of the same type or different type may be applied to each of the protrusion 52 of the metal mold 51 and the depression 62 of the metal mold 61.

Following the flame-retardant liquid application process as described above, the wooden piece 1 is compressed by the metal molds 51 and 61 (compression process). The compression process of the third embodiment is similar to the compression process of the first embodiment described above. The wooden piece 1 is left in the water vapor atmosphere of high temperature and high pressure as described above for a predetermined time period to be softened. Then, the softened wooden piece 1 is placed at a predetermined position, and the metal mold 51 is lowered so that the wooden piece 1 is sandwiched between the metal molds 51 and 61, whereby a predetermined compressive force is applied to the sandwiched wooden piece 1.

Figure 19:
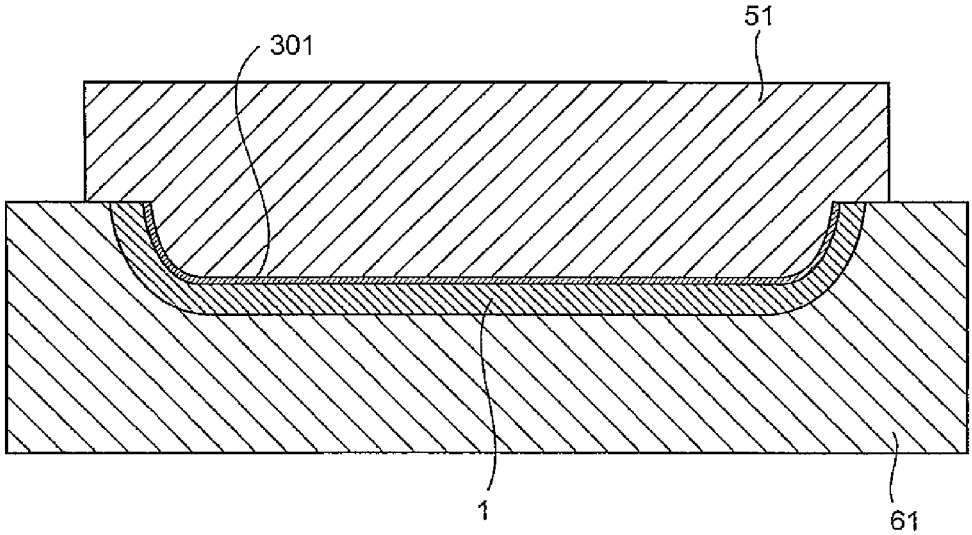
FIG. 19 is a sectional view of the metal molds and the wooden piece where deformation of the wooden piece has nearly finished in the compression process of the method of processing wood according to the third embodiment of the present invention.

FIG. 19 shows the softened wooden piece 1 placed at a predetermined position, sandwiched between the lowered metal mold 51 and the metal mold 61, and subjected to a predetermined amount of compressive force. In FIG. 19, the deformation of the wooden piece 1 by the compressive force has nearly completed. As shown in FIG. 19, the wooden piece 1 is deformed into a three-dimensional shape corresponding to the shape of a gap between the metal mold 51 and the metal mold 61 by the application of compressive force from the metal molds 51 and 61. Meanwhile, the flame-retardant liquid 301 applied on the surface of the protrusion 52 gradually soaks into the surface layer, of the internal face of the wooden piece 1 by compressive force.

Figure 20:
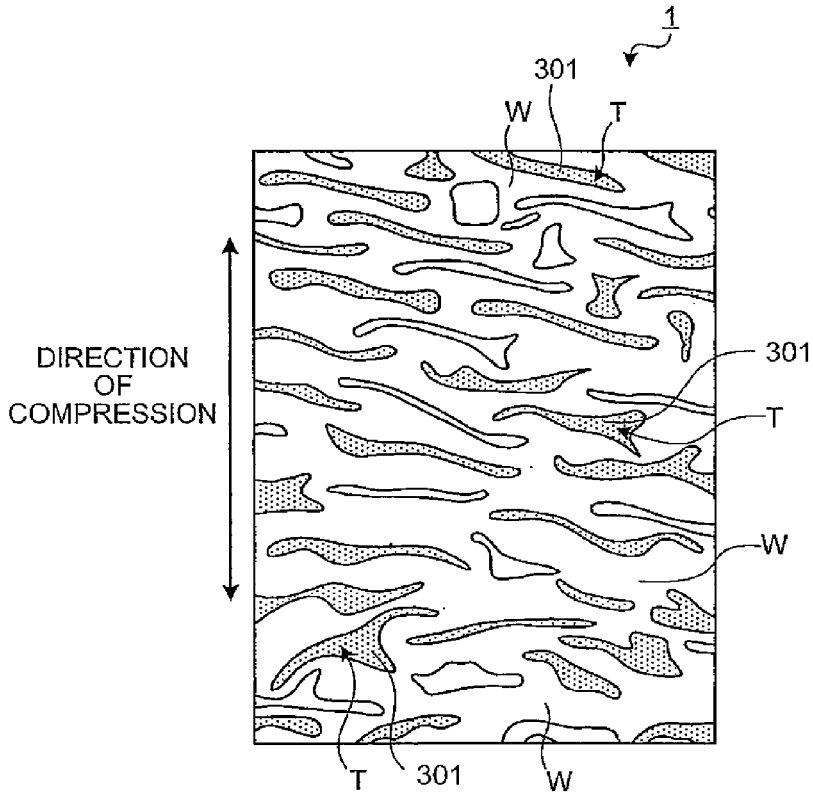
FIG. 20 schematically shows a configuration of a section of the wooden piece in a direction perpendicular to the direction of wooden fibers in the wooden piece after compressed into the compressed wood product by the method of processing wood according to the third embodiment of the present invention.

FIG. 20 schematically shows a portion of the surface layer of the wooden piece 1 after the soak of the flame-retardant liquid 301. More specifically, FIG. 20 schematically shows a section perpendicular to the direction L of wooden fibers in the surface layer of the wooden piece 1 after the compression, wherein the wooden piece is taken from softwood (Japanese cypress, hiba cedar, or the like). The portion of the surface layer of the wooden piece 1 before the compression is as schematically shown in FIG. 5. After the compression as shown in FIG. 20, the cell wall W is pressed in the direction of compression, and the openings of the tracheids T become narrower. The flame-retardant liquid 301 soaks into the surface of the wooden piece 1 to a certain depth mainly through the narrowed tracheids T, thereby forming the flame-retardant liquid impregnated portion N. Hence, the flame-retardant liquid 301 that soaks into the surface layer of the wooden piece 1 remains inside the tracheids T even after the wooden piece 1 is dried. When the wooden piece 1 is dried, in some cases, moisture contained in the flame-retardant liquid 301 evaporates to leave only the flame retardant inside the tracheids.

After the compressive force is applied to the wooden piece 1 for a predetermined time period (one to dozens of minutes, more preferably approximately five to ten minutes) in the compression process, the water vapor atmosphere is removed to dry the wooden piece 1. Then, the metal molds 51 and 61 are separated from each other so that the wooden piece 1 is released from compression. As a result, the thickness of the wooden piece 1 becomes approximately 30 to 50% of the thickness before the compression process.

Figure 21:
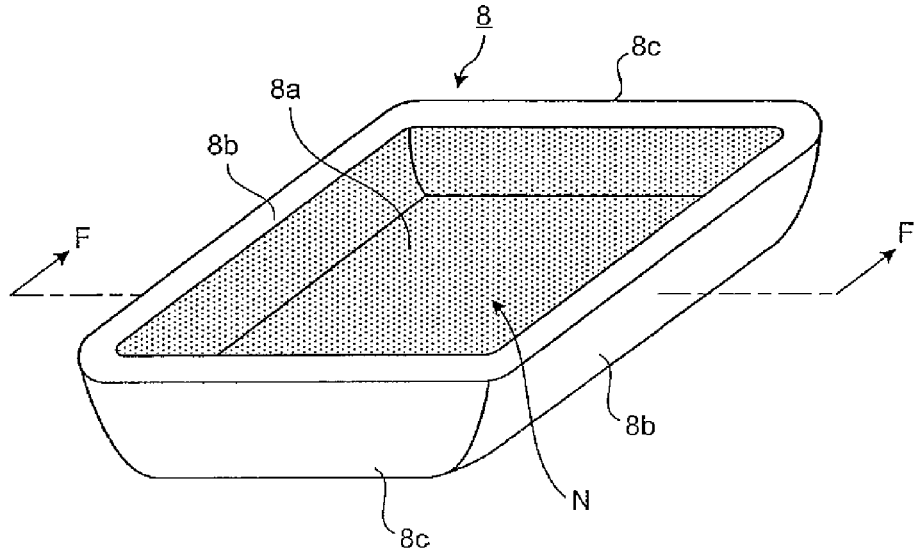
FIG. 21 is a perspective view of a configuration of a compressed wood product manufactured by the method of processing wood according to the third embodiment of the present invention.
Figure 22:
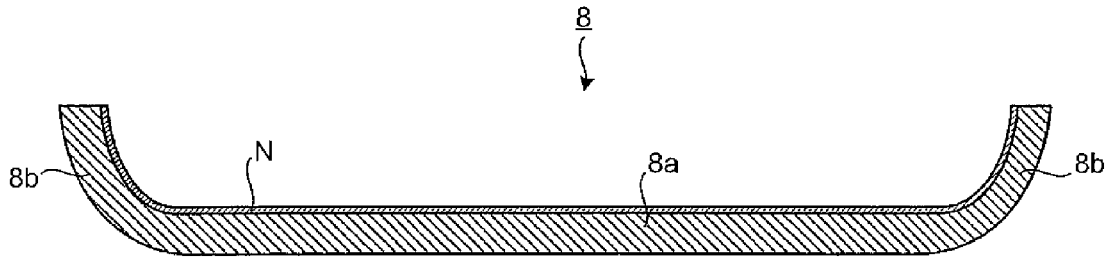
FIG. 22 is a sectional view taken along line F-F of FIG. 21.

FIG. 21 is a perspective view of a configuration of a compressed wood product manufactured by the method of processing wood according to the third embodiment. FIG. 22 is a schematic vertical sectional view of a section taken along line F-F of FIG. 21. A compressed wood product 8 shown in FIGS. 21 and 22 includes a main plate portion 8*a*, two side plate portions 8*b*, and two side plate portions 8*c* corresponding respectively to the main plate portion 1*a*, two side plate portions 1*b*, and two side plate portions 1*c* of the wooden piece 1. Further, the flame-retardant liquid impregnated portion N of a depth necessary and sufficient for flame retardancy is formed on the curved internal faces extending from main plate portion 8*a* to the side plate portions 8*b* and 8*c*, through impregnation of the flame-retardant liquid 301. The depth of the flame-retardant liquid impregnated portion N varies depending on the thickness and the compression rate of the compressed wood product 8 and the density of the wooden piece or the like. For example, preferably the depth of the flame-retardant liquid impregnated portion N is set deeper than the depth of possible scratch which may be formed during use of the compressed wood product 8, so that the property granted by the flame-retardant liquid 301 is not lost by the scratch.

FIG. 22 shows the flame-retardant liquid impregnated portion N as a separate part from the wooden piece. The flame-retardant liquid impregnated portion N is shown as such merely because FIG. 22 is a schematic drawing. Needless to say, the actual flame-retardant liquid impregnated portion N is formed through soak of the flame-retardant liquid 301 into the tracheids (or the vessels) surrounded by the cell wall as described with reference to FIG. 20.

Figure 23:
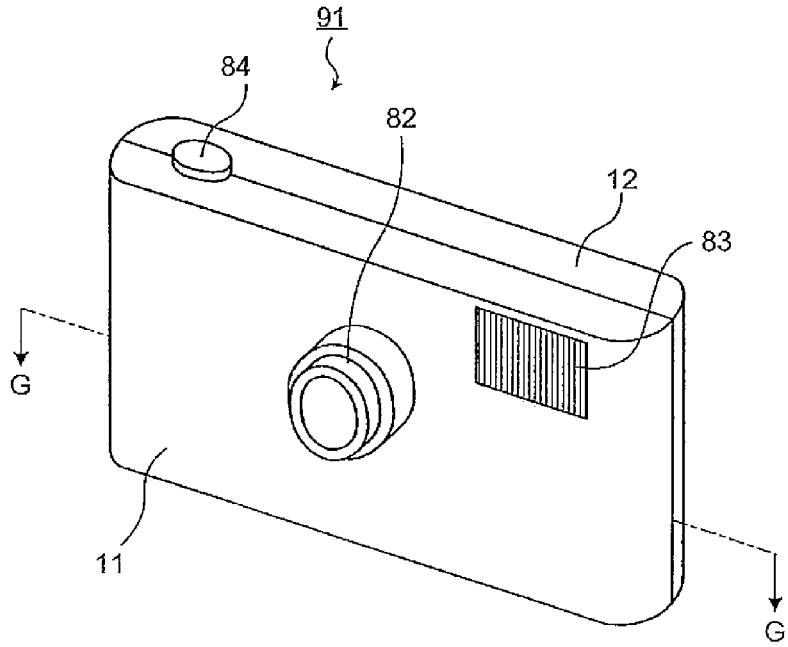
FIG. 23 is a perspective view of an outer appearance of a digital camera which includes the compressed wood products manufactured by the method of processing wood according to the third embodiment of the present invention as jacket materials.

FIG. 23 shows an example of application of the compressed wood product 8. More specifically, FIG. 23 is a perspective view of an outer appearance of a digital camera covered by cover members formed from the compressed wood products 8. A digital camera 91 shown in FIG. 23, similarly to the digital camera 81 of the first embodiment described above, includes the image pick-up unit 82, the photoflash 83, and the shutter button 84, and is covered by two cover members 11 and 12 formed from the compressed wood products 8.

Figure 24:
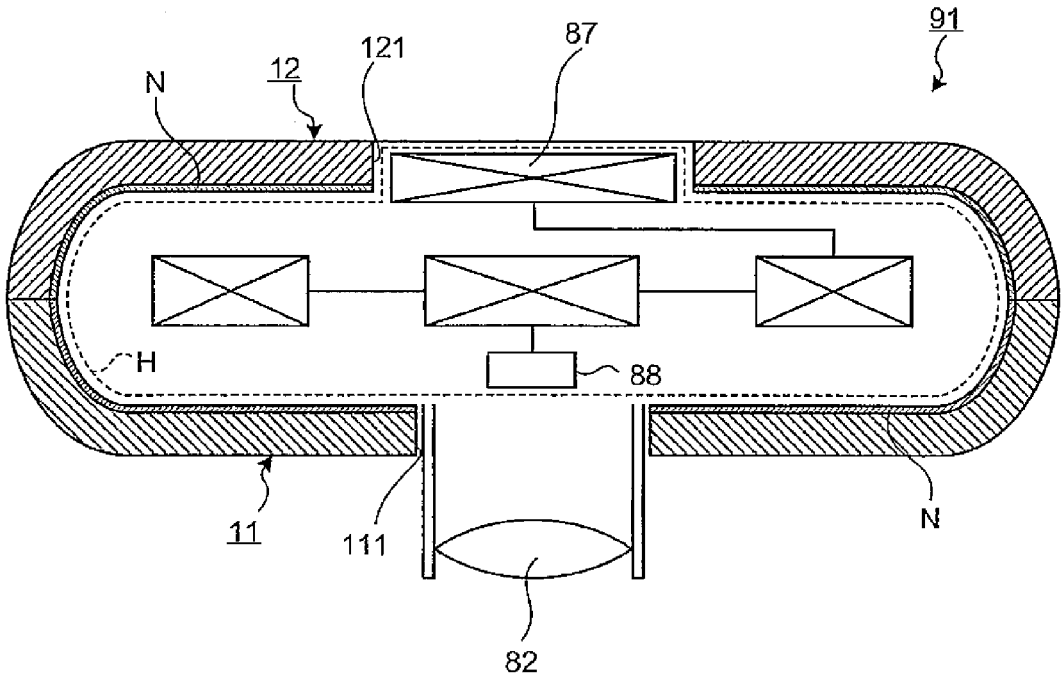
FIG. 24 is a sectional view taken along line G-G of FIG. 23.

FIG. 24 shows an inner configuration of the digital camera 91, and is a sectional view taken along line G-G of FIG. 23. Inside the digital camera 91, various components are housed, such as a display unit 87 realized by a liquid display, a plasma display, or an organic EL display for display of image information and text information, an imaging element 88 such as CCD or CMOS, a control circuit that performs drive control related to the imaging process or the like and various operations, a driving circuit that drives respective functioning units under the control of the control circuit, and the like. FIG. 24 schematically shows various functioning units having electronic or optical functions as described above by a region H (surrounded by a broken line) inside the digital camera 91.

In FIG. 24, the cover member 11 that covers the front side of the digital camera 91 includes an opening 111 to expose the imaging unit 82, whereas the cover member 12 that covers the rear side of the digital camera 91 includes, a rectangular opening 121 to expose the display unit 87. The openings 111 and 121 may be formed simultaneously with the cutting-out of the wooden piece 1, which is later processed into the cover member 11 or 12, from the raw wood 10. Alternatively the openings 111 and 121 may be formed after the compression process of the wooden, piece 1 by cutting, drilling, or the like.

When, the flame-retardant liquid 301 is also impregnated into the side surface of the opening 111, for example, an opening, which is later processed into the opening 111, may be formed in the wooden piece 1 before the compression process, and the metal molds are prepared so that the flame-retardant liquid 301 is impregnated into the side surface of the original opening. The same applies to the case where the flame-retardant liquid 301 is impregnated into the side surface of the opening 121. Specifically, the metal mold may be formed so that a portion of the metal mold contacts with the side surface of the original opening at the time of compression, and the flame-retardant liquid 301 is applied to the surface of the pertinent portion.

The flame-retardant treatment is performed conventionally to the wooden piece. However, when the flame-retardant treatment is performed to the raw wood from which each wooden piece is cut out, the flame-retardant liquid may not soak at all into the surface of the compressed wood product finally obtained, or the depth of impregnation of the flame-retardant liquid may be uneven. Then, the flame-retardant liquid needs, to be soaked again later. To eliminate such inconvenience, it may be possible to inject or impregnate the flame-retardant liquid into the compressed wood product. The compressed wood product, however, has a hardened surface compared with the surface before the compression, so the flame-retardant liquid may not soak into the compressed wood product by the amount necessary and sufficient for the flame retardance.

The third embodiment has the flame-retardant liquid application process and the compression process. In the flame-retardant liquid application process, the flame-retardant liquid which is in liquid state at the temperature of 5 to 35° C. is applied to the surface of at least one of the metal molds, the whole surface of which comes into contact with the surface of the wooden piece. In the compression process, the wooden piece is sandwiched and compressed, by the pair of metal molds including the metal, mold, to which the flame-retardant liquid is applied in the water vapor atmosphere of higher temperature and pressure than those of atmospheric air. Since the flame-retardant liquid is in liquid state or solid state in the water vapor atmosphere of the compression process, the flame-retardant treatment liquid can be made to soak into the predetermined portion of the wooden piece subjected to compression by the amount necessary and sufficient for the flame retardance.

According to the third embodiment of the present invention as described above, in the method of processing wood by a pair of metal molds, the property granting liquid (flame-retardant liquid), which grants a certain property to the surface of the wooden piece and which is in liquid state at the temperature of 5 to 35° C., is applied to the surface of at least one of the metal molds the surface of which comes into contact with the surface of the wooden piece, and the wooden piece is sandwiched and compressed by the pair of metal molds, to one of which, the property granting liquid is applied. Therefore, the desired property can readily be granted to the wooden piece subjected to compression.

Further, according to the third embodiment, since the flame-retardant liquid is soaked into the wooden piece while the wooden piece is compressed, the flame-retardant liquid can be more securely fixed to the surface of the wooden piece, whereby the flame-retardant effect can be expected to maintain for a long time.

Still further, according to the third embodiment, the external face of the three-dimensional dish-like wooden piece is adhered to the smooth surface of the metal molds, for the compression. The flame-retardant liquid impregnated portion is evenly formed on at least one surface of the wooden piece that abuts the metal mold to be compressed. Hence, such a compressed wood product is suitable for jacket materials of the electronic equipments which may unexpectedly catch fire, such as digital cameras provided with high-voltage flash circuit.

Figure 25:
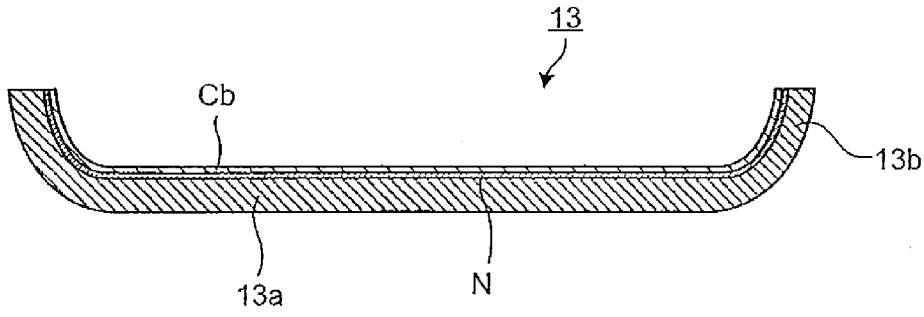
FIG. 25 shows a configuration of a compressed wood product whose internal face is carbonized.

The internal face of the compressed wood product processed by the method of processing wood according to the third embodiment may be carbonized by a gas burner or the like. FIG. 25 is a sectional view of the configuration of the compressed wood product after the carbonizing process, and is the same vertical section as in FIG. 22. A compressed wood product 13 of FIG. 25 (having a main plate portion 13*a*, side plate portions 13*b*, or the like) has a carbonized layer Cb on the internal face in addition to the flame-retardant liquid impregnated portion N. The compressed wood product 13 with such configuration has flame retardance by the flame-retardant liquid impregnated portion N and blocking property against the electromagnetic waves transmitted from outside by the carbonized layer Cb, whereby the compressed wood product 13 is further preferable for the application as the jacket material for the electronic equipments. The carbonizing process described above may be performed to the wooden piece 1 before compression.

Figure 26:
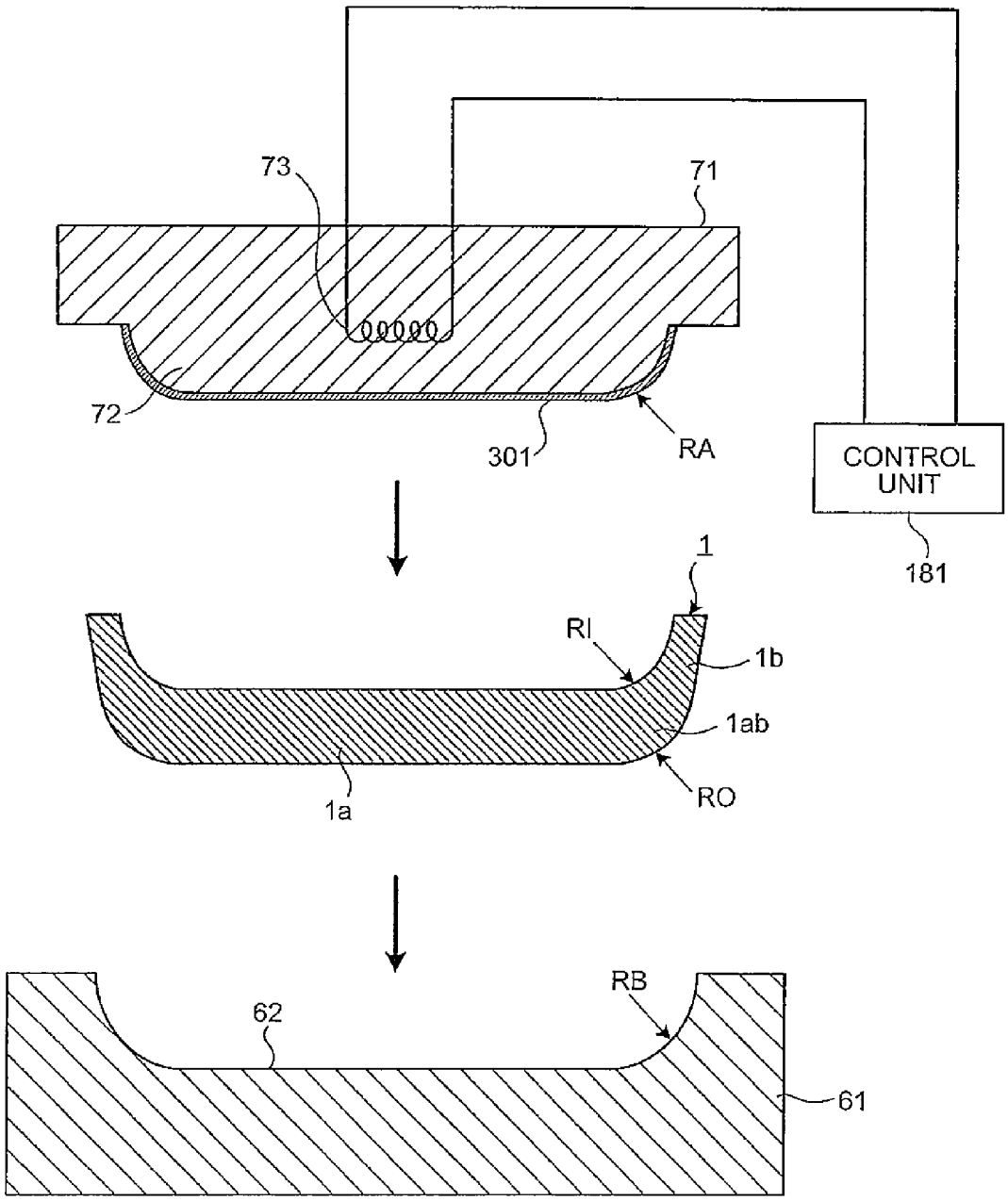
FIG. 26 shows an outline of a compression process in a method of processing wood according to a fourth embodiment of the present invention.

A fourth embodiment of the present invention intends to make the wooden piece flame retardant by making the flame-retardant liquid, which is the property granting liquid, soak into the surface of the wooden piece subjected to the compression similarly to the third, embodiment. FIG. 26 shows an outline of the compression process in the method of processing wood according to the fourth embodiment. In the fourth embodiment, similarly to the method of processing wood according to the third embodiment, the wooden piece 1 is cut out from the raw wood 10, sandwiched and compressed by the pair of metal molds 71 and 61. The metal mold 71 which applies compressive force to the wooden piece 1 from above is a core metal mold having a downward protrusion 72, and a heater 73 is provided inside the protrusion 72 for heating the metal mold 71. Further, the flame-retardant liquid 301 is applied to the surface of the protrusion 72 (the surface of the metal mold that comes into contact with the inner surface of the dish-like wooden piece 1). The heater 73 is connected to a control unit 181 which has a temperature control function. The metal mold 61 has the same configuration as described in the first embodiment.

When the wooden piece 1 is compressed, the wooden piece 1 is sandwiched between the metal molds 71 and 61, and compressed by a predetermined compressive force. At the same time, the metal mold 71 is heated by the heater 73 under the control of the control unit 181 until the metal mold 71 reaches a temperature higher than the carbonizing temperature (generally approximately 350° C.) of the wooden piece 1. As a result, the wooden piece 1 is deformed into the predetermined dish-like shape by compression, and the internal face of the wooden piece 1 which comes into contact with the protrusion 72 of the metal mold 71 that is heated to a higher temperature than the carbonizing temperature is carbonized.

Figure 27:
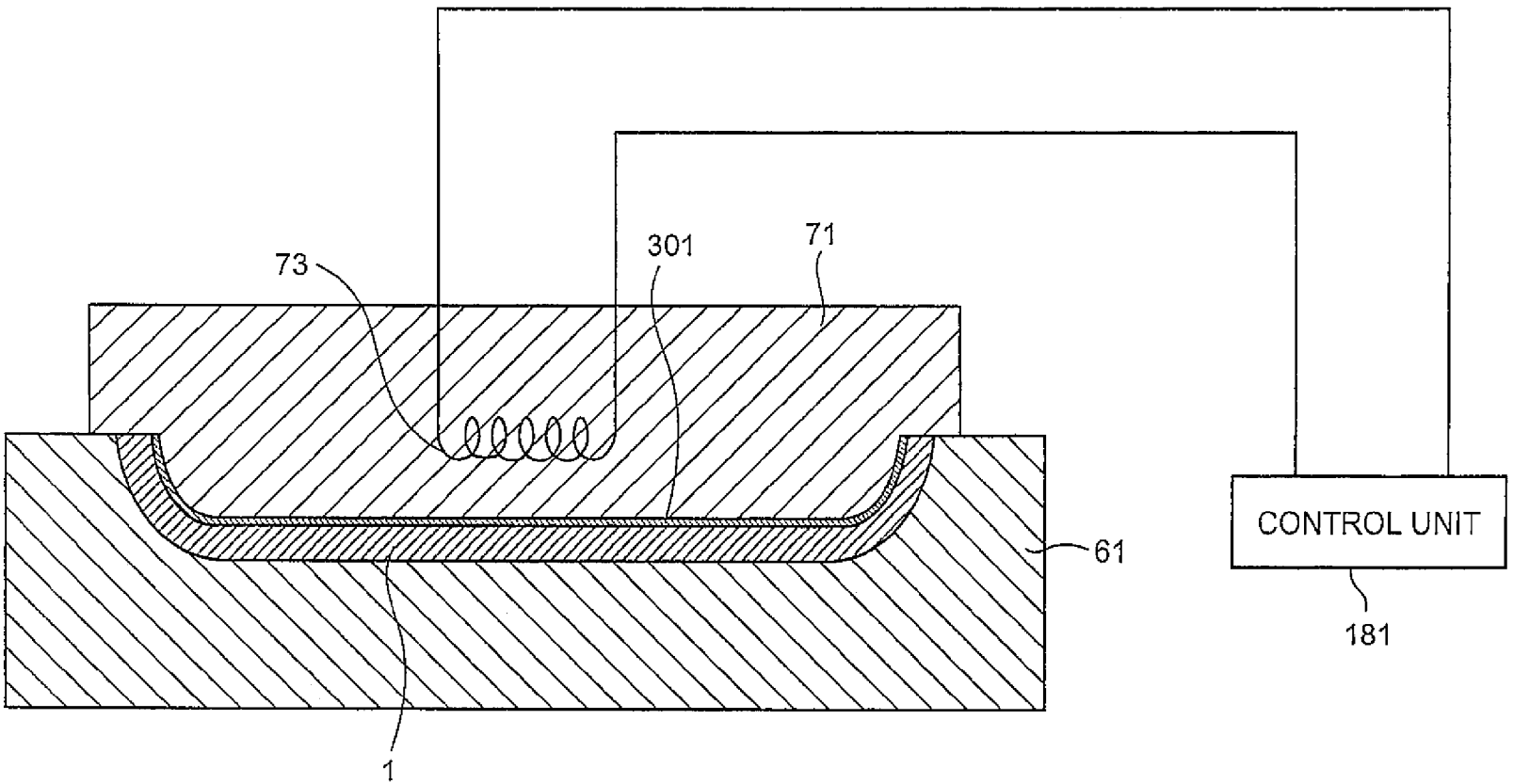
FIG. 27 shows the wooden piece whose deformation has nearly finished in the compression process of the method of processing wood according to the fourth embodiment of the present invention.

FIG. 27 shows the wooden piece 1 where the deformation thereof has been nearly completed in the carbonizing process. When the wooden piece 1 is left in the state shown in FIG. 27 for a predetermined time period, the flame-retardant liquid 301, similarly to the first embodiment, soaks into the internal face of the wooden piece 1. In addition, since the temperature of the metal mold 71 is higher than the carbonizing temperature of the wooden piece 1, the carbonized layer is formed in the internal face of the wooden piece 1 that comes into contact with the protrusion 72 of the metal mold 71. Thus, in the method of processing wood according to the fourth embodiment, the compression, flame-retardant treatment, and carbonization of the wooden piece are all performed simultaneously in the compression process.

The wooden piece 1 after the compression process is similar to the compressed wood product 13 shown in FIG. 25, with the flame-retardant liquid impregnated portion N and the carbonized layer Cb formed therein. In the fourth embodiment, however, since the flame-retardant treatment and the carbonizing treatment are performed in parallel, the flame-retardant liquid impregnated portion N and the carbonized portion Cb do not necessarily have a layered configuration as shown in FIG. 25, and the flame-retardant liquid impregnated portion N and the carbonized portion Cb may formed side by side on the surface layer of the internal face of the compressed wood product.

Thus, the fourth embodiment of the present invention as described above can provide similar effects as the third embodiment.

Further, according to the fourth embodiment, at least one of the pair of metal molds for processing wood is heated to a higher temperature than the carbonization temperature of the wooden piece in the compression process The heated metal mold is employed for the compression of the wooden piece, and the carbonization of the surface of the wooden piece which contacts therewith. Thus, the compression, flame-retardant treatment, and carbonizing of the wooden piece can be simultaneously performed. Therefore, the compressed wood product suitable for the jacket materials of the electronic equipments can be manufactured by a smaller number of processes, whereby the productivity of the compressed wood product can be improved.

Still further, since the flame-retardant liquid impregnated portion and the carbonized layer are formed in the internal face of the dish-like compressed wood product according to the fourth embodiment, the fourth embodiment is particularly suitable for the jacket material of the electronic equipments which are required to be provided with the carbonized layer at a position which cannot be directly seen from outside. In addition, when the flame-retardant liquid is soaked into the internal face, the decorating of the external face of the compressed wood product can be conducted without consideration of the effect of the flame-retardant liquid. Generally, the flame-retardant liquid impregnated portion and the carbonized layer may be formed on different surfaces.

In addition, since the carbonized layer itself is generally flame-retardant, the carbonized layer may serve to partly exert the flame-retardant effect, and the sufficient flame-retardant property can be secured even in the case that the depth of the flame-retardant liquid impregnated portion may be relatively shallow if the carbonizing process is performed before the flame-retardant treatment as in the third embodiment, or if the carbonizing process is performed simultaneously with the flame-retardant treatment as in the fourth embodiment.

The exemplary embodiments of the present invention are described above as the first to the fourth embodiments. The present invention, however, is not limited by the four embodiments. In other words, the present invention may include various embodiments not specifically described herein, and various modifications in design or the like can be performed within the scope of technical concepts identified by the appended claims.

INDUSTRIAL APPLICABILITY

The compressed wood product manufactured by the method of processing wood according to the present invention can be applied to jacket materials of small portable electronic equipments such as digital cameras, portable telephones, portable communication terminals such as PHS or PDA, portable audio devices, IC recorders, portable televisions, portable radios, remote controls for various home appliances, and digital video players/recorders. The compressed wood product manufactured by the method of processing wood according to the present invention may be also applied to cases for glasses, tablewares.

The invention claimed is:

1. A method of processing a wooden piece by a pair of metal molds, comprising: applying oil to a surface of at least one of the metal molds, the surface coming into contact with a surface of the wooden piece, wherein the oil is in liquid state at temperatures of 5 to 35° C.; and compressing the wooden piece with the wooden piece sandwiched by the pair of metal molds including the metal mold to which the oil is applied so that the oil is applied to the surface of the wooden piece.

2. The method according to claim 1, wherein the a boiling point of the oil is equal to or higher than 230° C.

3. The method according to claim 2, wherein the wooden piece is compressed into a dish shape, and the oil is applied to the surface of the metal mold which comes into contact with a surface of the wooden piece corresponding to an outer surface of the wooden piece as compressed into the dish shape.

4. The method according to claim 1, wherein the compressing is performed in a water vapor atmosphere of a higher temperature and pressure than temperature and pressure of atmospheric air, and the oil is in liquid state or solid state in the atmosphere in which the compressing is performed.

5. The method according to claim 4, wherein the oil is an essential oil, and the oil is contained in an essential oil containing liquid.

6. The method according to claim 5, wherein the essential oil is oil contained in a sap component of wood of a same type as the wooden piece.

7. The method according to claim 5, wherein the essential oil is oil contained in a sap component of wood of a different type from the wooden piece.

8. The method according to claim 5, wherein the essential oil containing liquid is liquid prepared by dissolving the essential oil in a solvent which is in liquid state at temperatures of 5 to 35° C.

9. The method according to claim 5, wherein the essential oil containing liquid is liquid prepared by dispersing the essential oil in a disperse medium which is in liquid state at temperatures of 5 to 35° C.

10. The method according to claim 5, wherein the essential oil containing liquid is liquid containing plural types of essential oil.

11. The method according to claim 5, wherein the wooden piece is compressed into a dish shape, and the essential oil containing liquid is applied to the surface of the metal mold which comes into contact with a surface of the wooden piece corresponding to an outer surface of the wooden piece as compressed into the dish shape.

12. The method according to claim 1, wherein the compressing includes heating at least one of the pair of metal molds up to a temperature higher than a carbonizing temperature of the wooden piece, compressing the wooden piece by the heated metal mold, and carbonizing a surface of the wooden piece which abuts the heated metal mold.

13. The method according to claim 12, wherein the metal mold heated in the compressing is applied with the oil.

14. The method according to claim 1, further comprising carbonizing at least one surface of the wooden piece, wherein the carbonizing is performed as a separate step from the compressing, and is performed before the compressing.

* * * * *